United States Patent [19]

Kiely et al.

[11] Patent Number: 4,632,663

[45] Date of Patent: Dec. 30, 1986

[54] MOORING AND TRANSFER SYSTEM AND METHOD

[75] Inventors: William L. Kiely, Cypress; Kristen I. Pedersen, Houston, both of Tex.

[73] Assignee: Sofec, Inc., Houston, Tex.

[21] Appl. No.: 728,325

[22] Filed: Apr. 29, 1985

Related U.S. Application Data

[63] Continuation-in-part of Ser. No. 578,586, Feb. 9, 1984, abandoned, which is a continuation-in-part of Ser. No. 503,638, Jun. 13, 1983, abandoned.

[51] Int. Cl.[4] ..... B63B 22/02

[52] U.S. Cl. ..... 441/5; 114/230

[58] Field of Search ..... 114/51, 53, 230, 264, 114/265, 293, 294, 257, 333; 441/3-5; 405/202-209; 166/350

[56] References Cited

U.S. PATENT DOCUMENTS

| | | | |
|---|---|---|---|
| 2,551,375 | 5/1951 | Hayward | 405/207 |
| 3,021,680 | 2/1962 | Hayward | 114/297 |
| 3,708,811 | 1/1973 | Flory | 441/5 |
| 4,081,872 | 4/1978 | Pedersen et al. | 114/230 |
| 4,127,004 | 11/1978 | Vilain | 405/205 |
| 4,573,425 | 3/1986 | Pomonik | 114/230 |

FOREIGN PATENT DOCUMENTS

| | | | |
|---|---|---|---|
| 133438 | 11/1960 | U.S.S.R. | 405/205 |

*Primary Examiner*—Galen L. Barefoot
*Assistant Examiner*—Jesûs D. Sotelo
*Attorney, Agent, or Firm*—Dodge, Bush & Moseley

[57] ABSTRACT

An offshore bulk fluid transfer system and method for its deployment in both shallow and deep water is disclosed. The system is adapted for transfer of fluids between a tanker and another location. Deep water embodiments of the invention provide for a three and four stair step method for deploying the base on the sea floor. Additionally, a method of retrieving the system from the sea floor is disclosed. The offshore bulk fluid transfer system comprises a base and buoyancy tanks attached to the base flotation for the system during its transportion to a mooring location. Buoyancy tanks are adapted for flooding to allow the system to be deployed on the sea floor.

24 Claims, 48 Drawing Figures

10
20
22
56
26
25
37
23
39
39
21

35
22
33
36
62
10
20
51
52
56
53
50
29
36
31
54
55
26
28
25
24
37
30
34
39
27
40
23
38
33
40
36
39
35
21

145
29'
23
102
130
CURRENT 145
29'
138
23
136
143
132

145
134
142
147
23
24
140
24
144
143
130
138
132
136

147
145
24
144
143
29'
24
142
134
140
130
132
100

FIG. 33
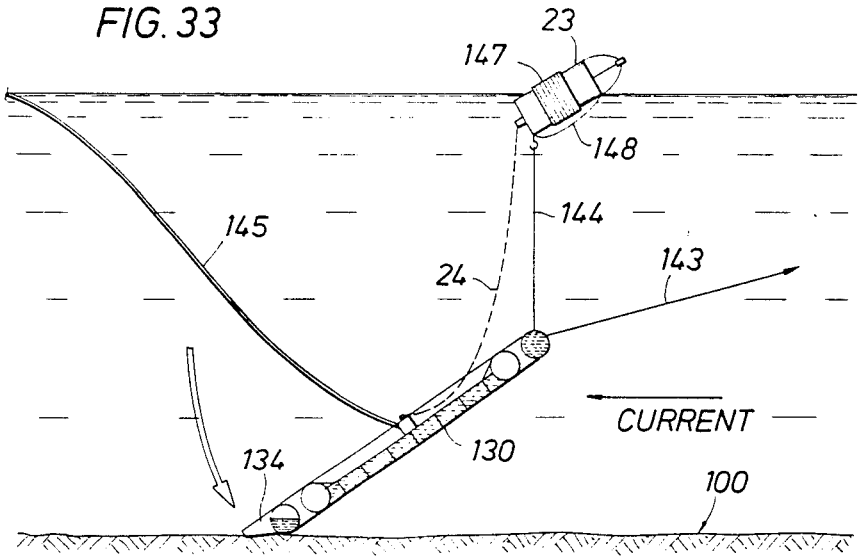
FIG. 34
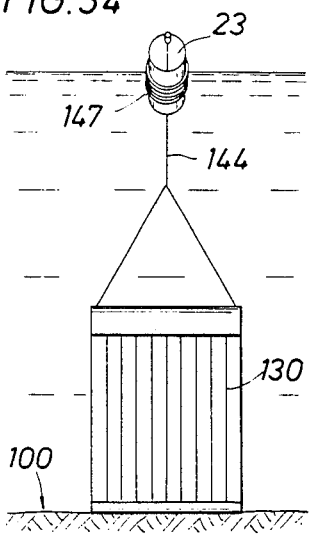
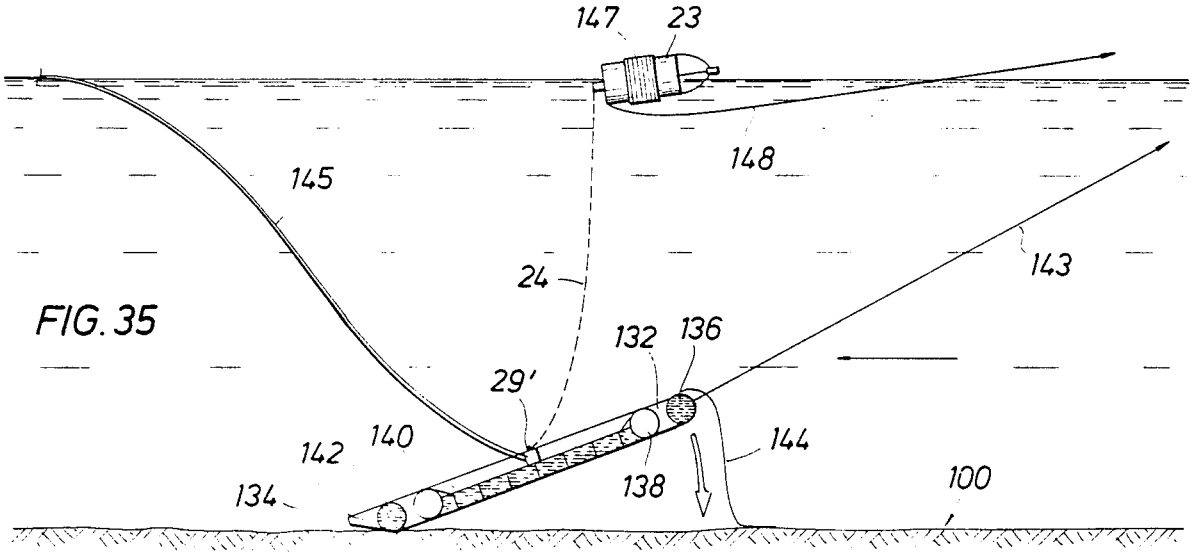
FIG. 35
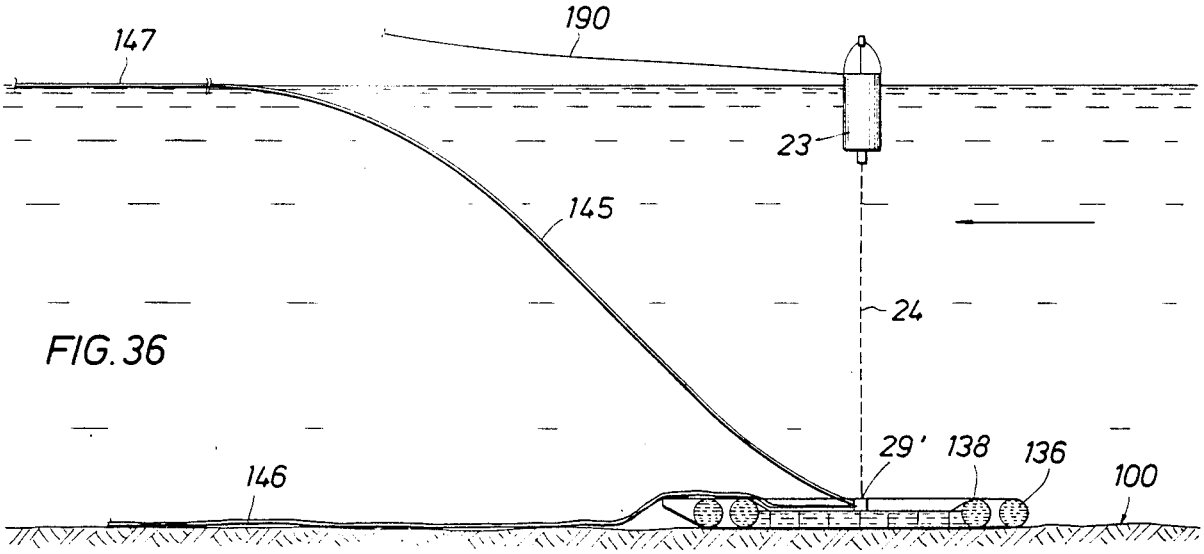
FIG. 36

FIG. 37
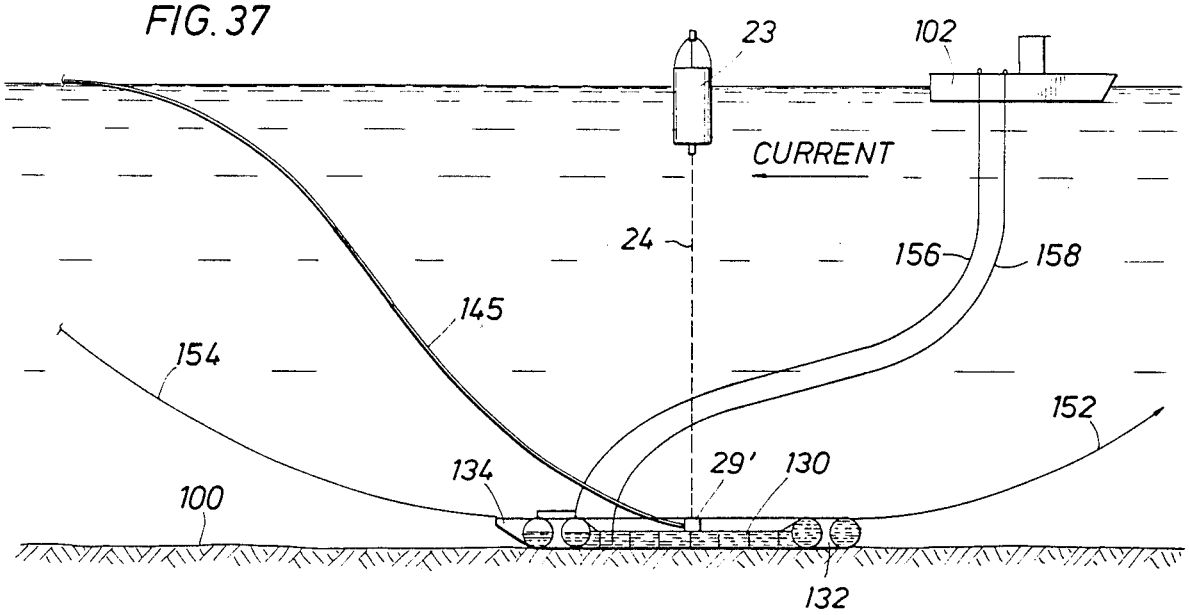
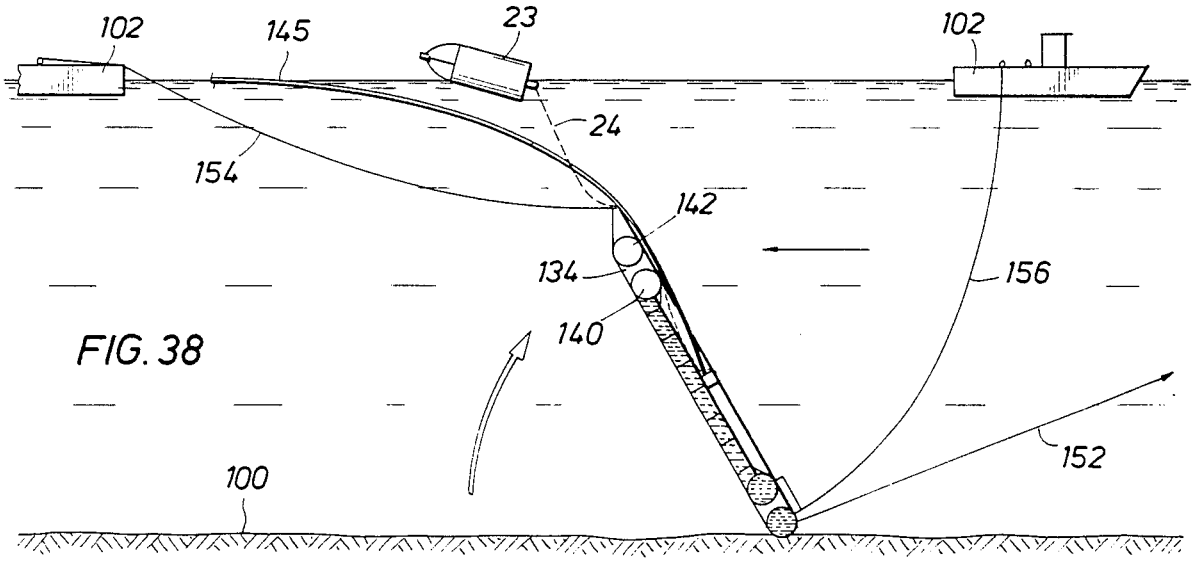
FIG. 38
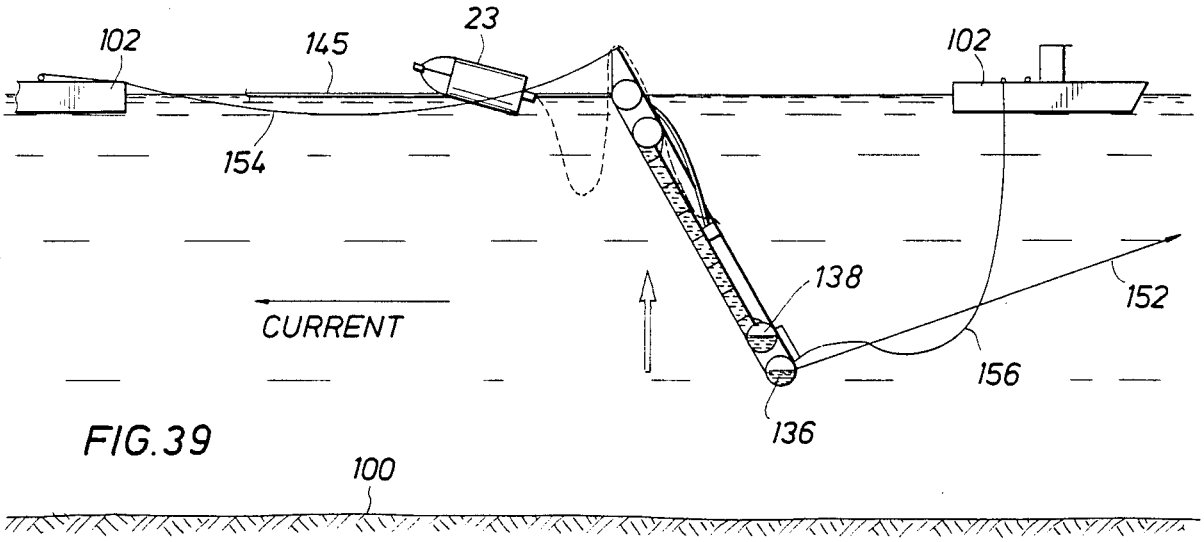
FIG. 39

MOORING AND TRANSFER SYSTEM AND METHOD

CROSS REFERENCE

This application is a continuation-in-part of application Ser. No. 578,586 filed Feb. 9, 1984, now abandoned which is a continuation-in-part of application No. 503,638 filed June 13, 1983, now abandoned.

BACKGROUND OF THE INVENTION

1. Field of the Invention

This invention relates generally to a mooring and transfer system and more particularly to a rapid deployable and recoverable mooring and transfer system for fluid cargo between a tanker ship and another location. The invention relates to a method and apparatus which may be particularly advantageous for use in military activities whereby fuel from a tanker may be rapidly unloaded via a transportable mooring and pipeline system to a shore location. The invention also may have general commercial applications.

2. Description of the Prior Art

Mooring systems and associated pipelines are known by which fluid such as oil aboard a tanker may be offloaded and transported to shore locations. Particularly in military situations, there is a potential need for rapid deployment of a mooring and pipeline system by which fuel from a tanker may be very quickly supplied to forces landed on a beach. Fuel may be dropped by helicopters, etc., but the quantity of fuel to support a large landing force must be provided by an ocean going tanker. Speed in offloading of the oil or fuel from the tanker to the shore forces is an obvious requirement.

IDENTIFICATION OF THE OBJECTS OF THE INVENTION

It is therefore an object of the invention to provide a rapid deployable and recoverable mooring and transfer system for fluid cargo between a tanker ship and another location.

It is a further object of the invention to provide a rapid deployable offshore mooring and bulk liquid discharge system and method for its operation.

It is a further object of the invention to provide a system which may be landed in relatively shallow water providing a mooring for an ocean going tanker and providing pipeline means from the tanker to a shore location.

It is a further object of the invention to provide such a rapid deployable offshore bulk liquid discharge system which may be used in relatively deep water.

It is a further object of the invention to provide a system which may be transported to a mooring location and in which a mooring buoy and rapid deployable pipeline system may be deployed from a tanker to the shore and carried in a single unitary system.

SUMMARY OF THE INVENTION

The objects mentioned above as well as other advantages and features of the invention are disclosed in the detailed description of the invention which follows. In summary, an offshore bulk fluid transfer system comprises a base and buoyancy tank means attached to the base for providing flotation for the system during its transportation to a mooring location. The buoyancy tanks are adapted for flooding to allow the system to be deployed on the sea floor.

Disclosed is a method for deploying an offshore bulk fluid transfer system to the sea floor. The transfer system includes a base with a first end and a second end with flooding means for the first end and for the second end. The preferred method comprises positioning the offshore bulk transfer system at a deployment location and then flooding the first end of the base of the system causing the first end to sink towards the sea floor. The first end of the base is then held at a predetermined depth from the sea floor. Then the flooding of the second end of the base is commenced so that the base rotates about the first end until the second end of the base engages the sea floor. Finally, the first end of the base is released operably enabling the first end of the base to sink to the sea floor.

An alternative method for deploying an offshore bulk fluid transfer system to the sea floor is disclosed. The transfer system comprises a base with a first end and a second end with flooding means for the first end and flooding means for the second end. Additionally, the system comprises supporting means for the first end and the second end of the base at predetermined depths. The alternative method comprises the steps of positioning the offshore transfer bulk transfer system at a desired deployment location. The first end of the base is then flooded causing the first end to sink towards the sea floor. After the first end sinks to a depth closer to the sea floor than the second end, the first end is then supported. The flooding of the second end is then commenced and the second end of the base is released operably enabling the second end of the base to rotate about the first end to a depth closer to the sea floor than the first end. The second end of the base is then supported. The first end of the base is then released operably enabling the first end of the base to rotate about the second end. The steps of supporting and releasing of the desired ends are repeated until the first or second end of the base engages the sea floor.

BRIEF DESCRIPTION OF THE DRAWINGS

The foregoing summary of the invention and other objects and advantages of the invention will be described in more detail below taken in conjunction with the accompanying drawings of which:

FIGS. 29–36 illustrate an alternative system and method for deep water deployment of the system. If there is a current, the system is positioned at a deployment location substantially in cooperating alignment with the current where the first or up current end of the base may be held at a predetermined depth from the sea floor. The second or down current end then rotates about the first end until the down current end engages the sea floor. The first end is then released and completely flooded allowing the base to sink to the sea floor;

FIGS. 27–41 illustrate a system and method for retrieving an offshore bulk fluid transfer system from the sea floor.

DESCRIPTION OF THE INVENTION

Shallow Water Embodiment With Hose Reel and Pipeline Reel

Figure 2:
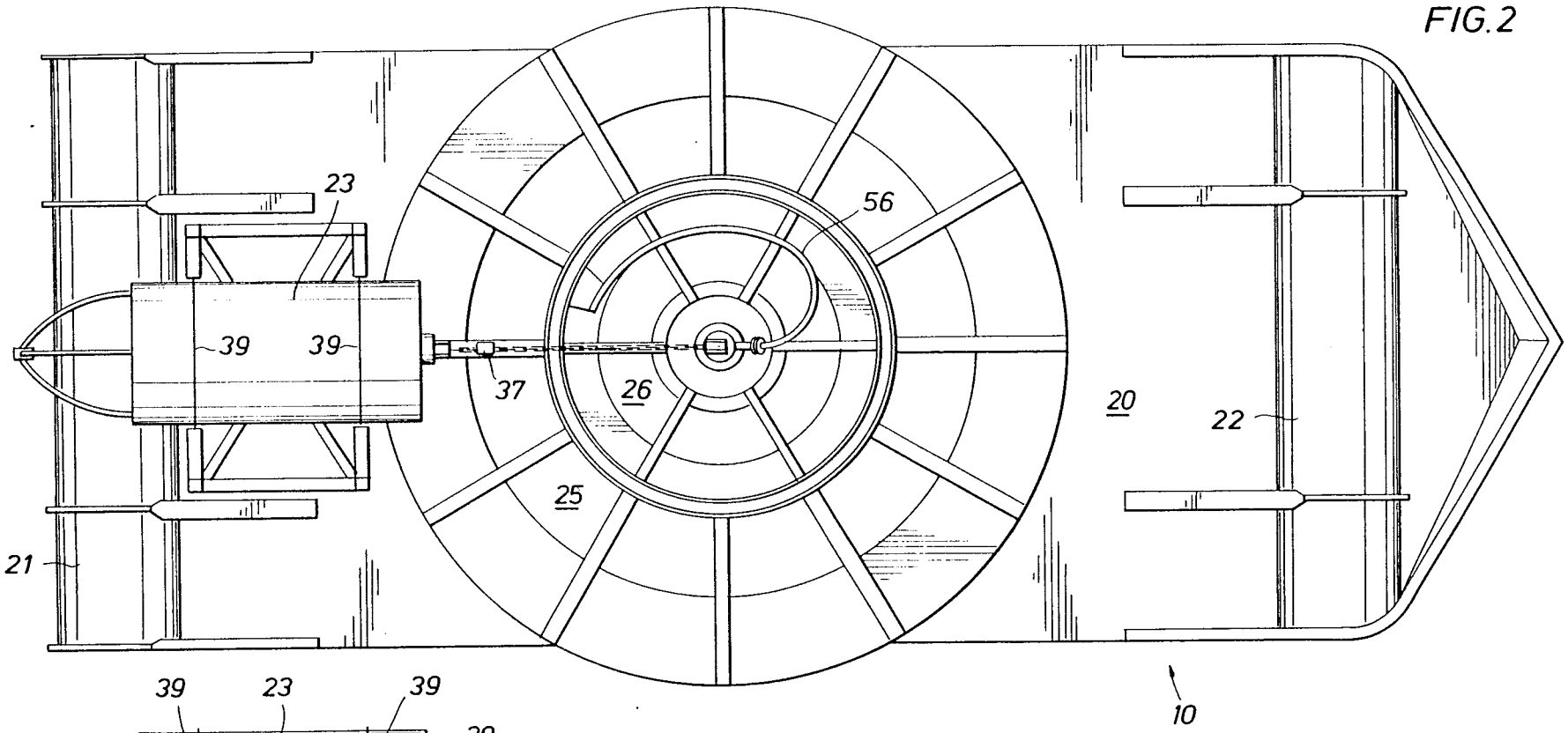
FIGS. 1 and 2 are a side and top view of a rapid deployment mooring and transfer system according to the invention illustrating the base, buoyancy tanks, mooring buoy, pipeline reel and hose reel.
Figure 1:
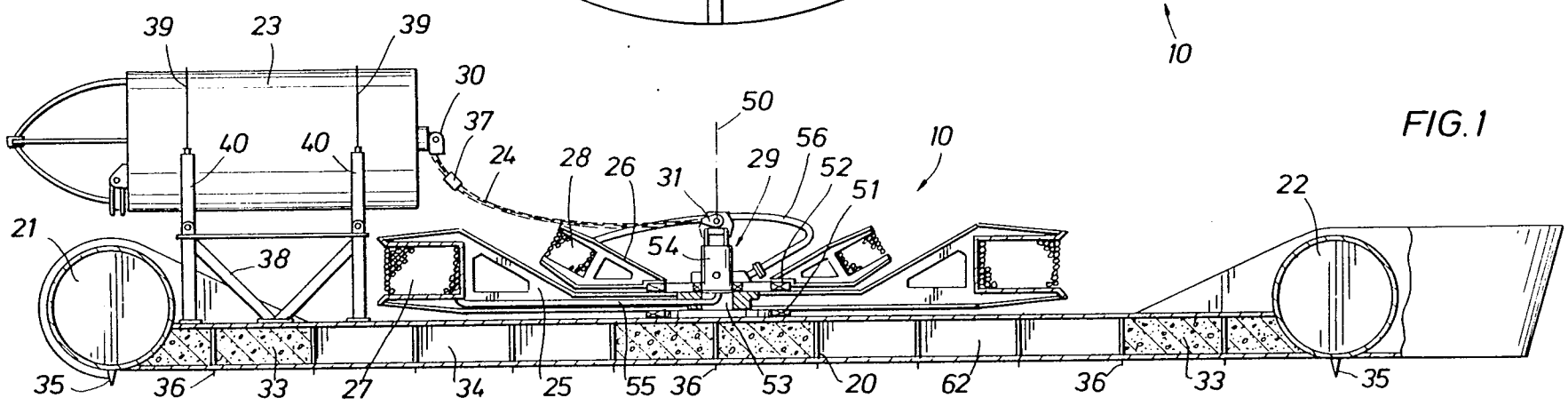

FIGS. 1 and 2 illustrate a side and plan view of an embodiment of the transfer system according to the invention which is especially adapted for use in relatively shallow water. The system 10 includes a base 20 with floodable buoyancy tanks 21 and 22 disposed at either end of the base. A mooring buoy 23 is releasably secured to a support structure 38 on the base by means of two hinged buoy cradle brackets 40 and releasable securing straps 39. Mounted on the base is a pipeline reel 25 which is free to rotate about centerline 50 on slewing rings 51. The pipeline reel holds a coil of flexible pipeline 27 during transportation of the system to a mooring location and reels the flexible pipeline 27 to a shore facility after the system is deployed on the sea floor. A hose reel 26 is provided for holding a coil of flexible tanker hose 28 during transportation of the system to a mooring location and for reeling the hose 28 to a tanker after the system is disposed on the sea floor. A swivel piping means or product swivel 29 is provided for rotationally coupling a coil of flexible pipeline 27 held in the pipeline reel 25 with a coil of tanker hose 28 held in the hose reel 26.

Mounted coaxially and nested above the pipeline reel 25, the hose reel 26 rotates with respect to the pipeline reel 25 on slewing rings 52. A product swivel 29 is disposed coaxially with centerline 59 and includes a central section 53 fixed to the pipeline reel 25 and an outer swivel section 54 free to rotate independently. A conduit 55 provides communication between the inner terminating end of pipeline coil 27 and the central section 53 of product swivel 29. The outer swivel section 54 includes a conduit coupling means 56 to which the inner end of the hose coil 28 is attached.

The pipeline reel 25 and the hose reel 26 are free to rotate with respect to each other and to the base 20 while the hose 28 and pipeline 27 are in fluid communication with each other via the product swivel 29 and conduit 55.

A tether 24 is attached to the lower end of mooring buoy 23. Preferably the tether 24 is an anchor chain attached to the top of the central section 53 of product swivel 29. Universal joints 30 and 31 terminate the tether 24 at the end of mooring buoy 23 and at the top of swivel 29. An anchor leg swivel 37, allowing the buoy to rotate independently, is preferably inserted in the tether means.

The base is segmented into a plurality of compartments, some of which are filled with concrete ballast illustrated by reference numerals 33. Others of the compartments 34 may be empty, providing flotation of the base during transport of the system to the deployment location, yet allowing flooding with water during deployment of the base on the sea floor. Soil penetration skirts 35 and soil shear ribs 36 provide shear resistance between the vehicle and the sea floor once the system is landed on the sea floor. Alternatively, a number of short spud piles penetrating the sea floor may be provided to achieve adequate resistance against sliding of the base.

The above described embodiment of the invention is suitable for deployment in relatively shallow water of depth not exceeding approximately seventy (70) percent of the length of the base structure.

Figure 3:
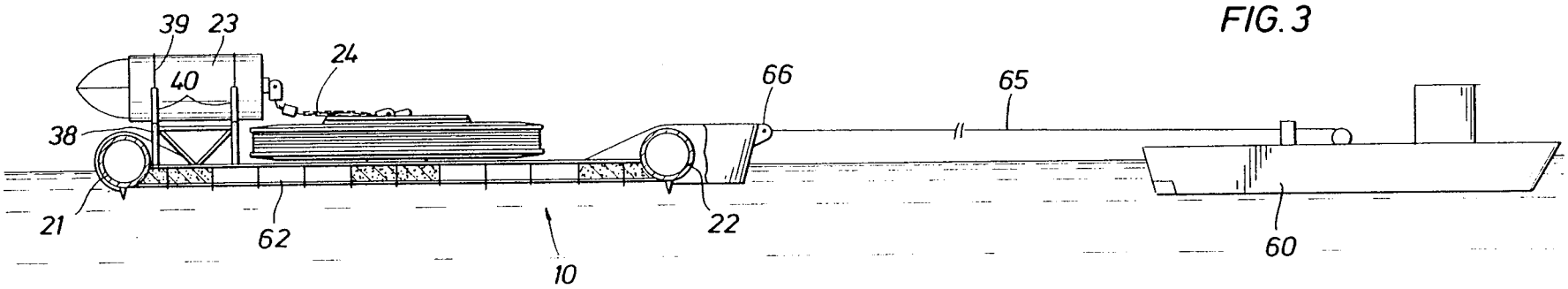
FIGS. 3 through 6 illustrate the method of deploying the system of FIGS. 1 and 2 in relatively shallow water.

FIGS. 3 through 6 illustrate the steps of the method of landing the system 10 on the sea floor 100. As illustrated in FIG. 3, a towing vessel 60 is used to tow the system 10 to the desired deployment location. During towing, the tether or anchor chain 24 may be adjusted to the proper length corresponding to the depth of water at the deployment location.

Figure 4:
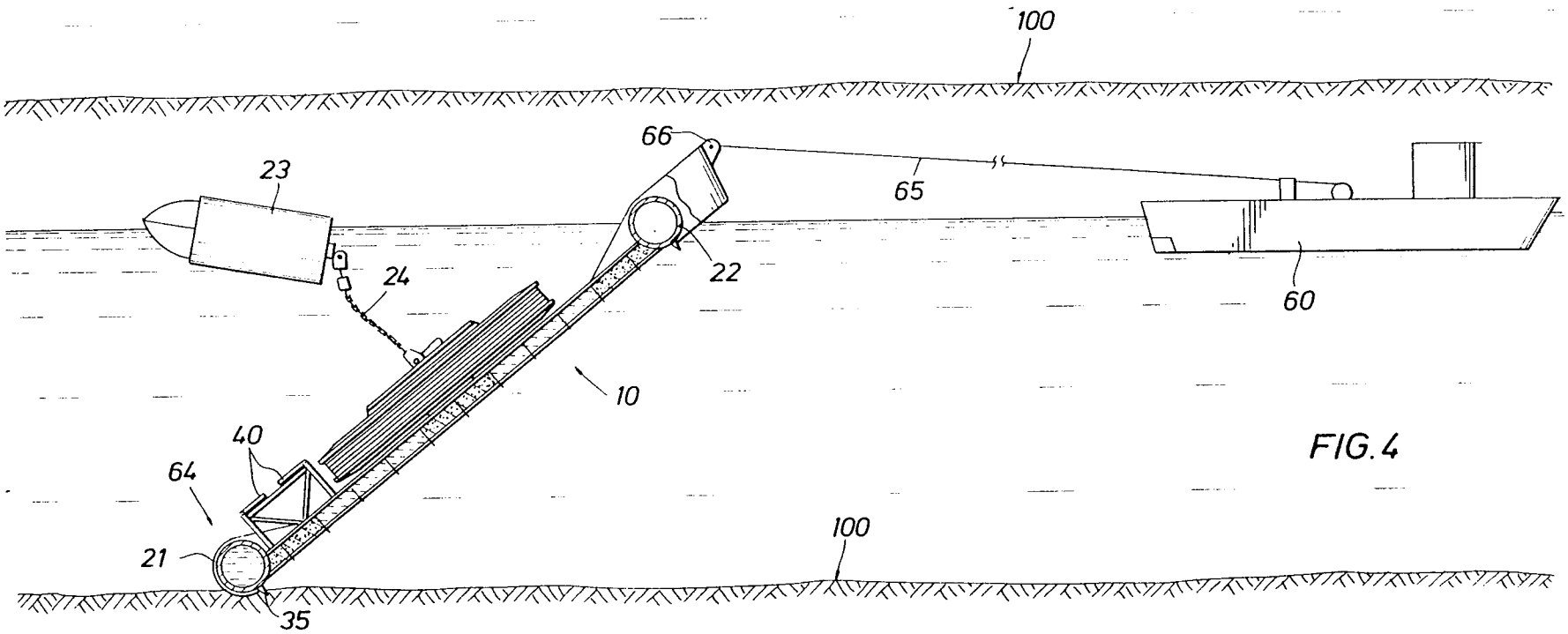

FIG. 4 illustrates the lowering of the system 10 after all empty hull compartments such as 62 of system 10 have been flooded and the buoy tie down cables 39 have been released. After the buoy 23 floats free, as illustrated, the hinged buoy cradle brackets 40 are laid down on top of the support structure to minimize the obstruction height of the installed system. The buoyancy tank 21 is illustrated as being flooded in FIG. 4. The base structure 20 gradually tilts down until the end 64 of system 10 with soil penetration skirt 35 engages the sea floor 100.

Figure 5:
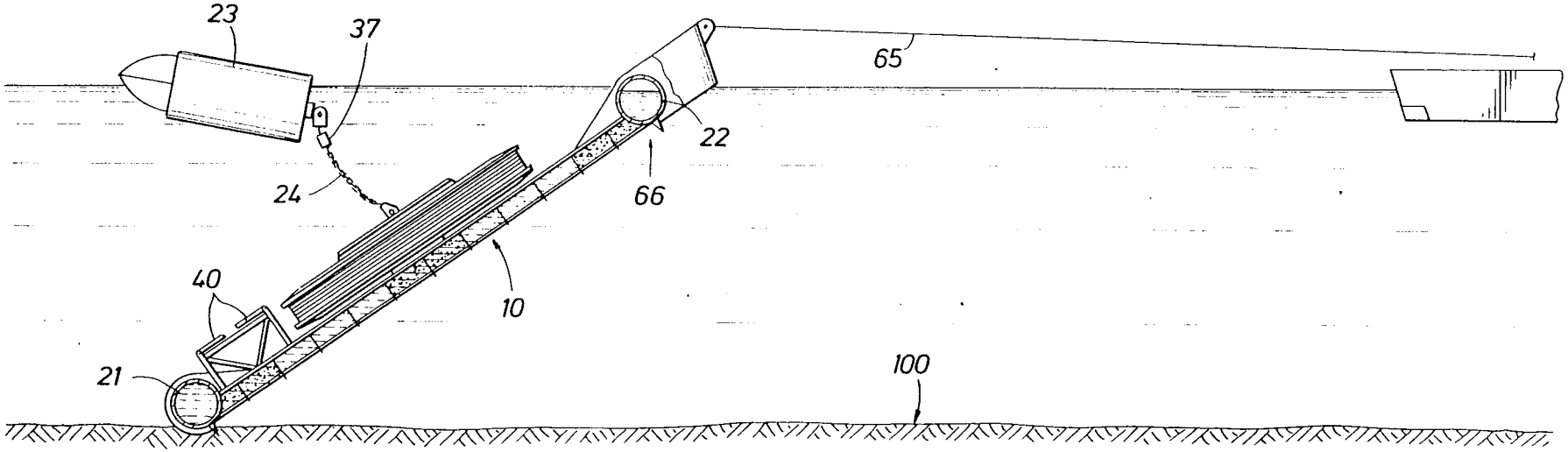

FIG. 5 illustrates the condition of the system 10 as buoyancy tank 22 is flooded with water. With the complete flooding of buoyancy tank 22, the opposite end 66 of system 10 sinks to the bottom of the sea floor.

Figure 6:
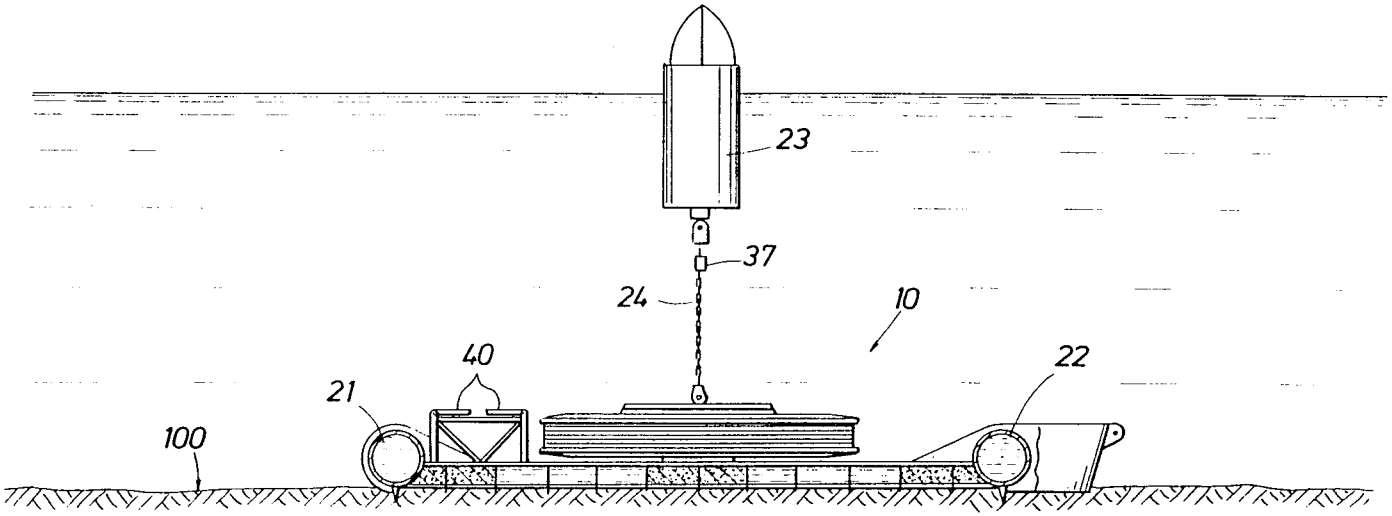
Figure 7:
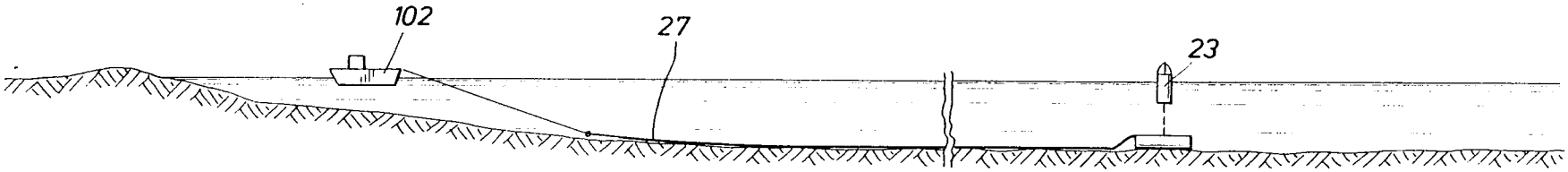
FIGS. 7 through 10 illustrate the deployment of the flexible pipeline to an onshore facility and the flexible hose to a tanker and the mooring of the tanker to the mooring buoy.
Figure 8:
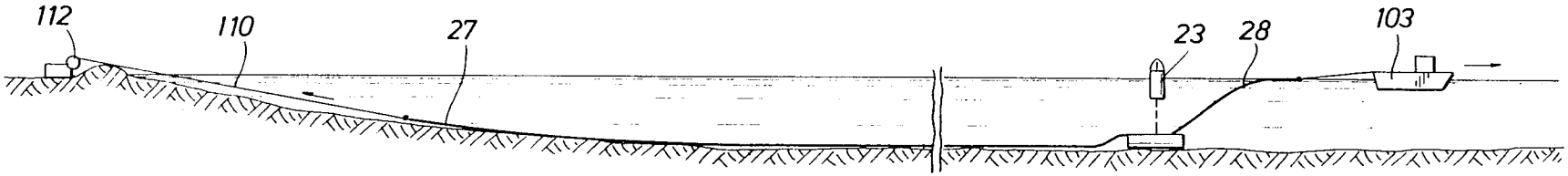

FIG. 6 illustrates the condition of the system 10 after being landed on sea floor 100 with the mooring buoy 23 pulled down to its final vertical position. Buoy 23 is tethered to the system 10 by means of tether 24. The length of the tether 24 is selected such that the mooring buoy 23 is pulled down to a depth that produces adequate buoyancy uplift on the buoy to maintain a predetermined tension force in the tether 24 under conditions of low tide.

FIGS. 7 through 10 illustrate the deployment of the pipeline 27 and the flexible hose 28. A towing vessel 102 is attached to the end of flexible pipeline 27 unreeling flexible pipeline 27 from pipeline reel 25. The empty flexible pipeline has a net submerged weight adequate to stabilize the pipeline on the sea floor but light enough to be pulled to shore without excessive friction resistance along the sea floor.

Figure 9:
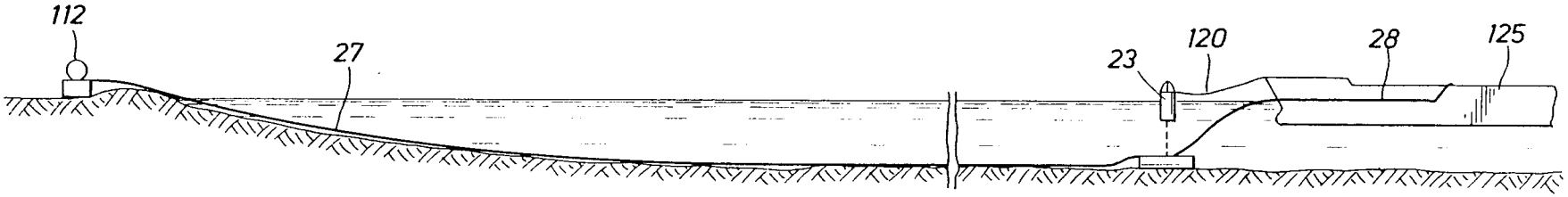

When the depth of the water becomes too shallow for vessel 102 to operate, a line 110 is unspooled from an onshore winch 112 and connected to the end of flexible pipeline 27. As illustrated in FIG. 9, winch 112 pulls the flexible pipeline onshore where it may be connected to onshore storage facilities 115, as illustrated in FIG. 10.

Returning now to FIG. 8, the end of the flexible hose 28 on hose reel 26 is unreeled by pulling on its end from a vessel 103. The flexible hose 28 has adequate built-in buoyancy capacity to float the hose not only during connection to the tanker 125, but also after the hose is filled with liquid cargo product. FIG. 9 illustrates that a tanker may then be moored to the mooring buoy 23 by means of a mooring hawser 120. Flexible hose 28 may be connected to the loading or unloading connection of tanker 125.

Figure 10:
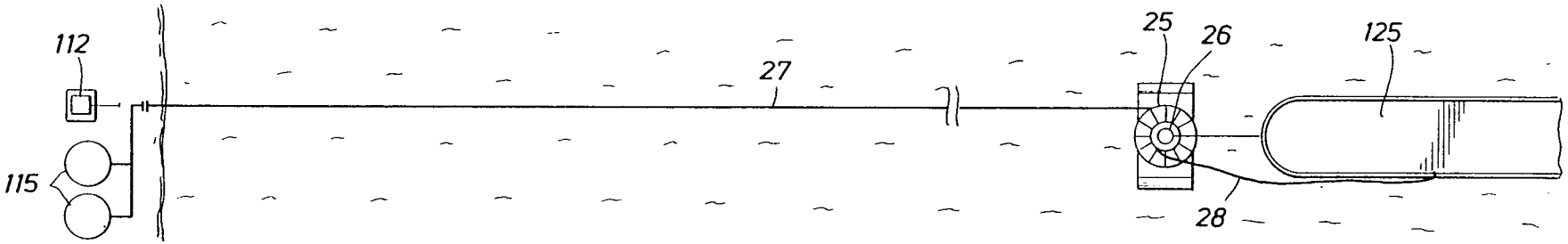

FIG. 10 illustrates in plan view that the hose 28 is spooled from reel 26 while flexible pipeline 27 is spooled from pipeline reel 25.

For positional control of the system during the lowering process, the method may include the step of attaching holding lines between the second end of the system and a retaining vessel which maintains position under power or is anchored with fluke imbedment anchors.

Thus there has been provided a method and system by which a tanker laden with fuel or other liquids may be rapidly provided with a deployed mooring system and discharge conduit by which its contents may be discharged for onshore storage.

Deep Water Embodiment With Hose Reel and Pipeline Reel

Figure 12:
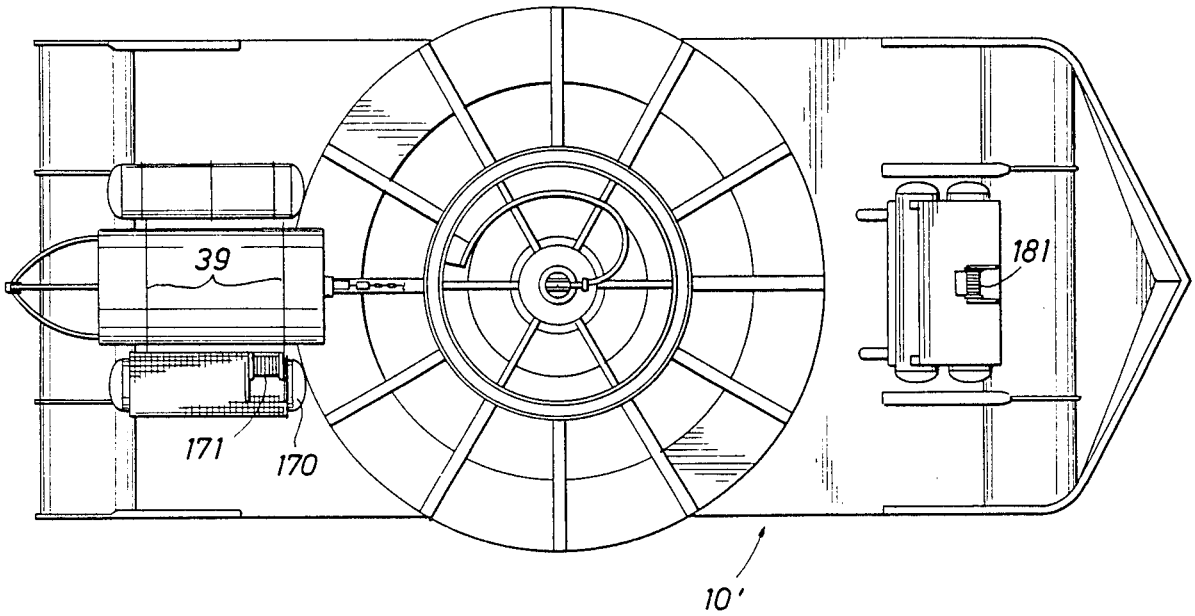
FIGS. 11, 12 and 13 illustrate in side, top and section views an alternative embodiment of the system especially adapted for deployment in relatively deep water and especially illustrating a first block and tackle and winch associated with the mooring buoy and an auxilliary buoy and second block and tackle and winch associated with the opposite end of the system.
Figure 11:
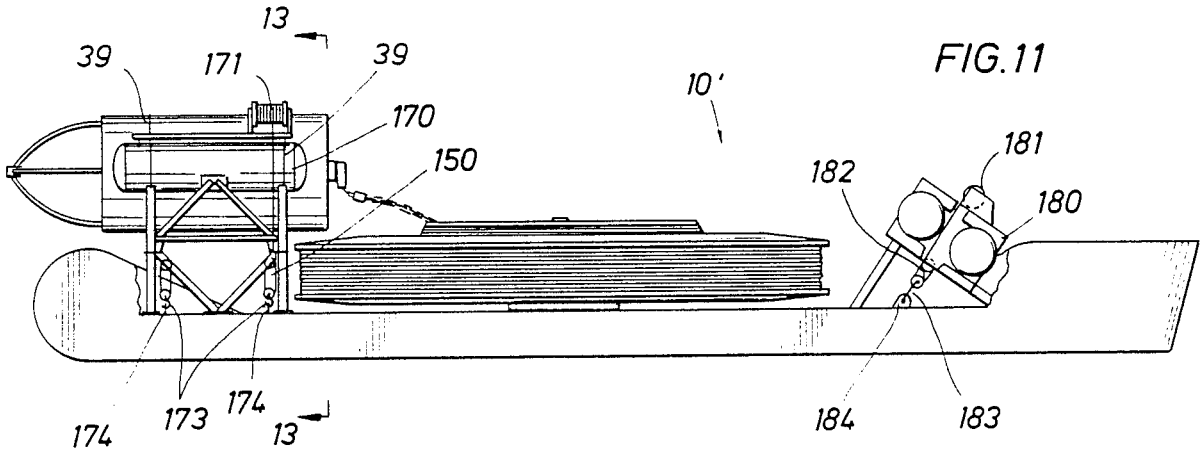
Figure 13:
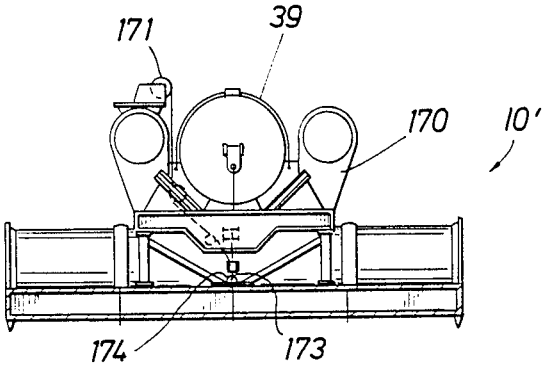

An alternative embodiment of the invention, system 10', is illustrated in FIGS. 11, 12 and 13 in side, top and section views. The system depicted in FIGS. 11, 12 and 13 is essentially the same as the system illustrated in FIGS. 1 and 2 but with additional apparatus to land the system in a controlled and safe manner in relatively deep water. A first block and tackle means 150 is attached to winch buoy cradle 170. First winch 171 mounted on winch buoy cradle 170 is operationally connected to block and tackle means 150 for lowering the first end of the base toward the sea floor. The block and tackle means 150 are attached to base 20 by means of hooks 173 in lifting padeye 174. At the second end of the base 20 is provided an auxiliary buoy 180 with a second winch 181 and a second block and tackle means 182 which is releasably connected to the base 20 by means of hook 183 in lifting padeye 184. The second winch 181 is provided for lowering the second end of the base to the sea floor. In other respects, the system 10' as shown in FIGS. 11, 12 and 13 is similar to the system shown in FIGS. 1 and 2.

Pipeline reel, hose reel and swivel piping means are provided on the base in a similar fashion to that described above for the shallow water embodiment of the invention. A buoy cradle 170 releasably secured to the first end of the base is provided in which the primary buoy of the mooring system is releasably secured. A tether is connected between the base and the primary buoy. As before, a swivel piping means is provided for rotationally coupling the coil of flexible pipeline held in the pipeline reel with a coil of tanker hose held in the hose reel.

Figure 14:
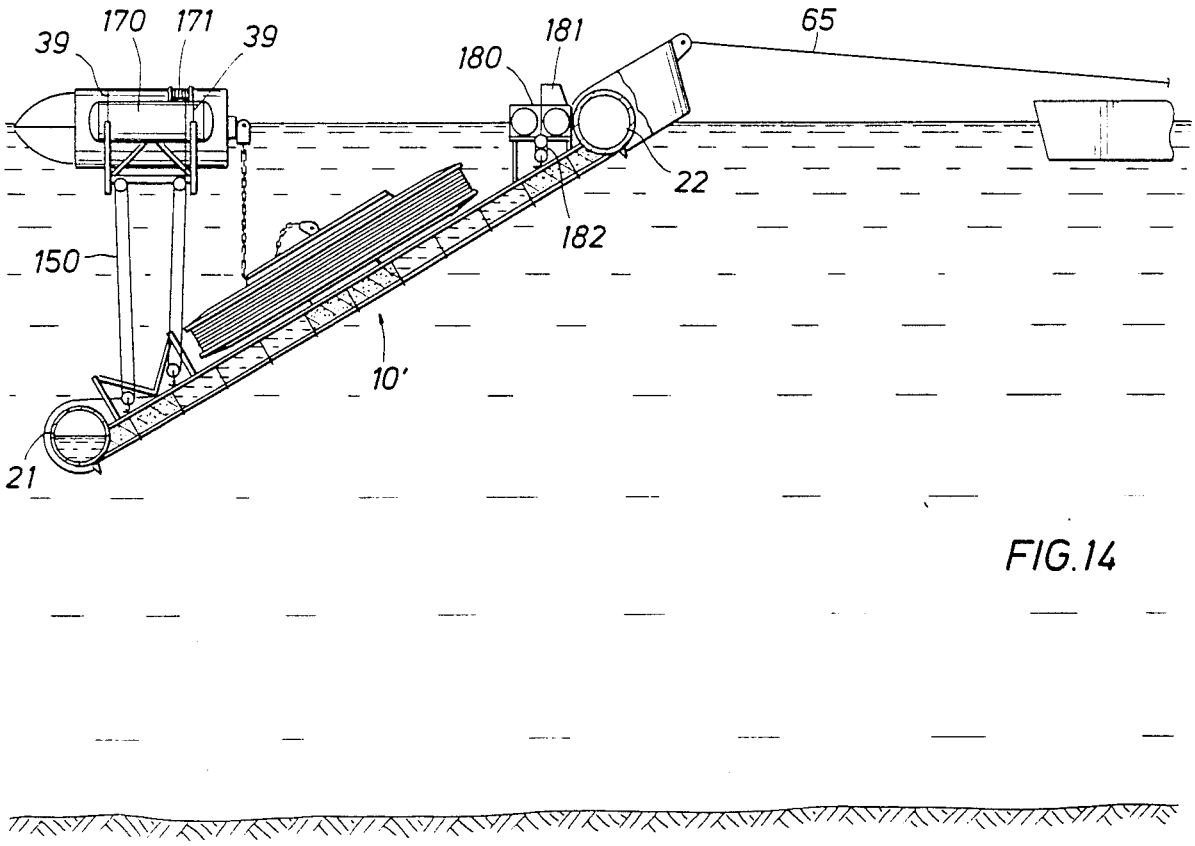
FIGS. 14 through 17 illustrate the method of landing the system illustrated in FIGS. 11 through 13 in relatively deep water.

FIGS. 14 through 17 illustrate the steps of the method of landing the deep water embodiment of the system 10' in preparation of unspooling pipeline 27 and hose 28 connecting a tanker 25 with an onshore storage facility 115. FIG. 14 illustrates the first step in the method of landing system 10'. First, after the system is towed to its deployment location, all the empty hull compartments are flooded. Then buoyancy tank 21 is flooded until the first end of the system 10' begins to submerge. The block and tackle means 150 under the control of winch 171 on buoy cradle 170 is then caused to lower the first end of system 10' to an inclined position, as illustrated in FIG. 14.

Figure 15:
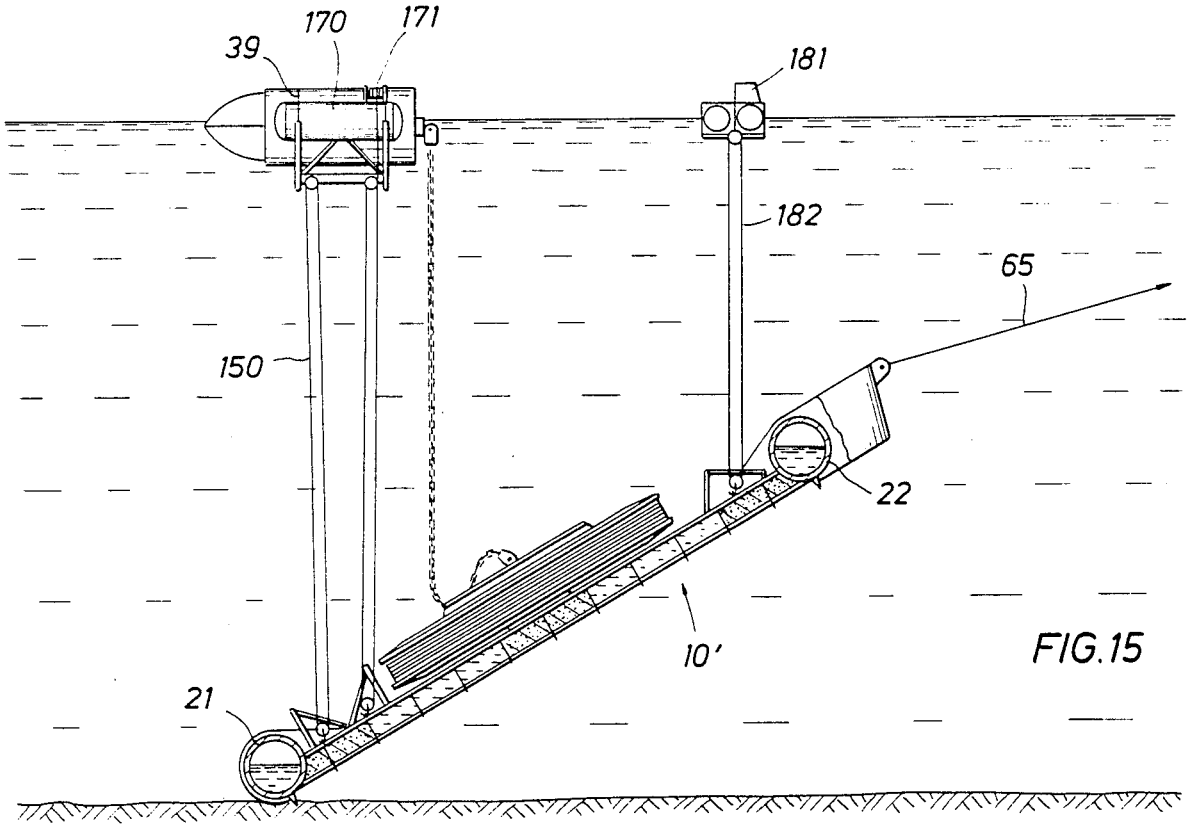

FIG. 15 illustrates that the buoyancy tank 22 is flooded until the second end of system 10' is initially submerged. At that point, the entire system 10' is lowered in the inclined position as illustrated in FIG. 15 whereby the block and tackle means 150 under control of winch 171 and block and tackle means 182 under control of which 181 are lowered at substantially the same rate until the end of system 10' at which buoyancy tube 21 is disposed lands on the sea floor 100.

Figure 16:
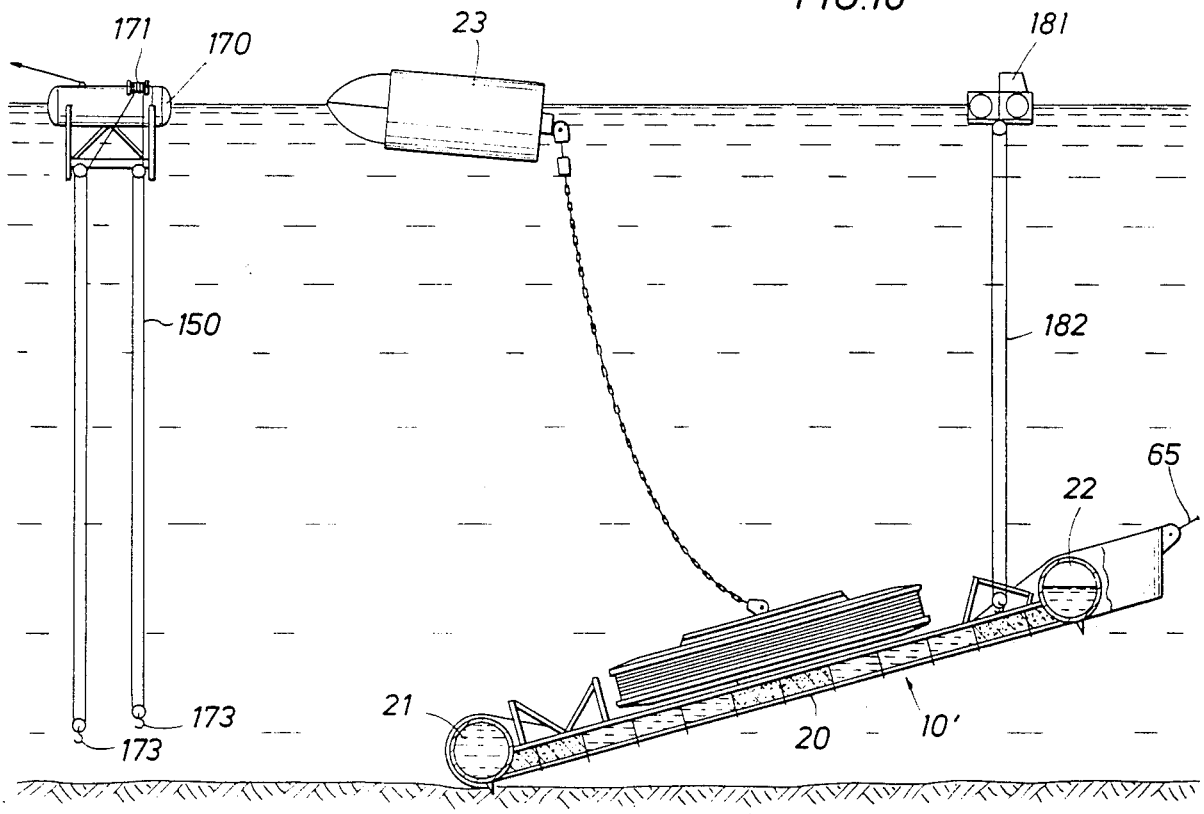

The buoyancy tank 21 is then completely flooded and the winch 171 is allowed to completely pay out until the block and tackle means 150 are slack. The buoy tie-down cables 39 are then released and the hooks 173 are disconnected from system 10'. At that point, the buoy cradle 170 is removed from the buoy 23 leaving the buoy 23 floating freely as illustrated in FIG. 16, while being tethered to the base.

Figure 17:
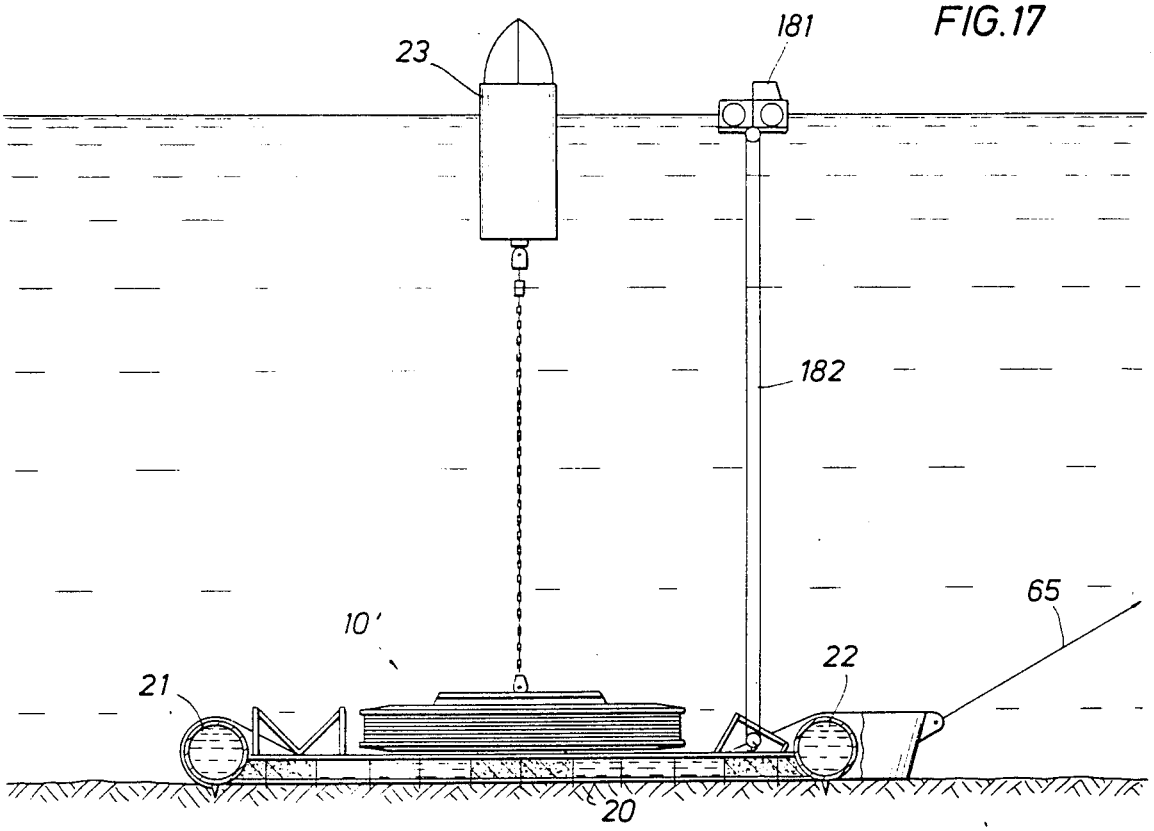

FIG. 17 illustrates the next step in the method of deploying the system 10' in relatively deep water. The end of system 10' at which buoyancy tank 22 is disposed is lowered to the sea floor by the auxiliary buoy winch 181. The second buoyancy tank 22 is then completely flooded and the auxiliary winch 181 and block and tackle means 182 are released from the system 10'. After landing as illustrated in FIG. 17, tow line 65 is also released from base 20. The deployment of the pipeline 27 on pipeline reel 25 to an onshore location is identical to the method outlined and illustrated with respect to FIGS. 7 through 10 discussed above. Likewise, the deployment of the flexible hose 27 from hose reel 26 is deployed to a tanker which is moored to mooring buoy 23. The tanker may then transfer fluid through the flexible tanker hose and flexible pipeline.

Thus there has been provided alternative embodiments of a system and method for rapid deployment of a mooring and bulk liquid discharge system for marine operations.

After the need for the tanker discharge facility at a given deployment location has ended, the entire system may be recovered for future redeployment by simply reversing the deployment procedures described herein.

Shallow Water Embodiment Without Pipeline Reel and With Hose Reel

Figure 18:
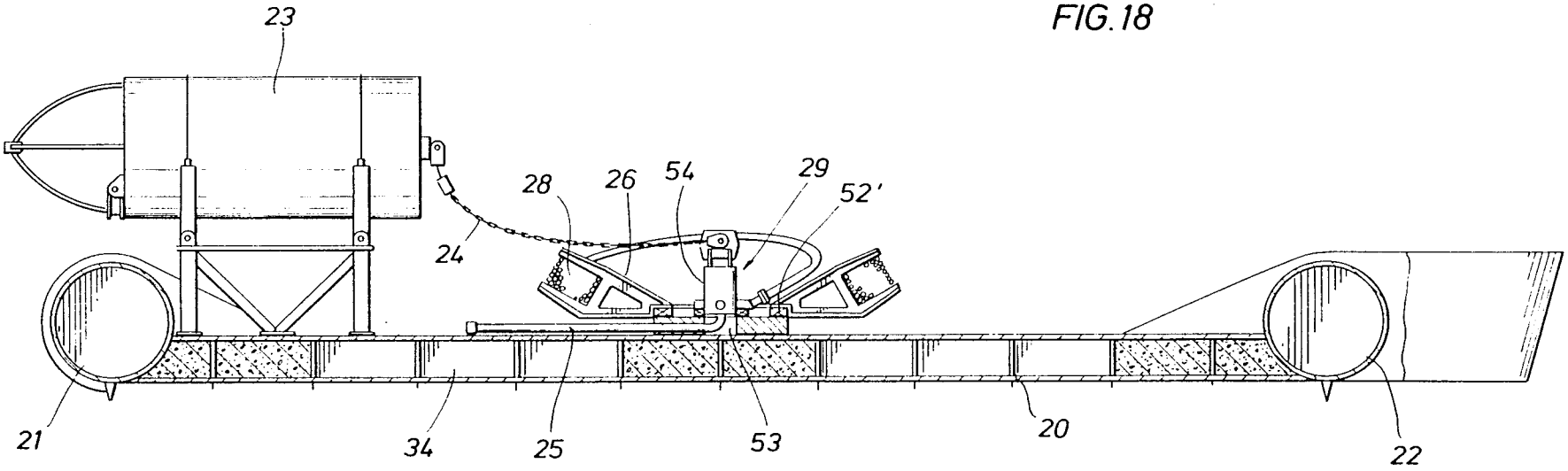
FIG. 18 illustrates an alternative embodiment of the invention in which the pipeline reel is omitted from the system of FIGS. 1 and 2 or FIGS. 11–13.

Another alternative embodiment of the invention is illustrated in FIG. 18 which may be adapted for use with the shallow water embodiment of the invention illustrated in FIGS. 1 and 2 or the deep water embodiment of the invention of FIGS. 11–13. As FIG. 18 illustrates, the pipeline reel 25 of FIGS. 1 and 2 or FIGS. 11, 12 and 13 may be omitted from the system. After the system of FIG. 18 is deployed on the sea floor, a pipeline may be connected to conduit 25 and then laid along the sea bed to an onshore storage facility through the use of specially designed separate deployment means or conventional marine pipeline laying equipment and techniques. Fluid communication is established through the pipeline and conduit 25 and via product swivel 29 to tanker hose 28. Tanker hose 28 is then connected to the tanker and the tanker is moored to the mooring buoy in the same manner as described previously.

Figure 20:
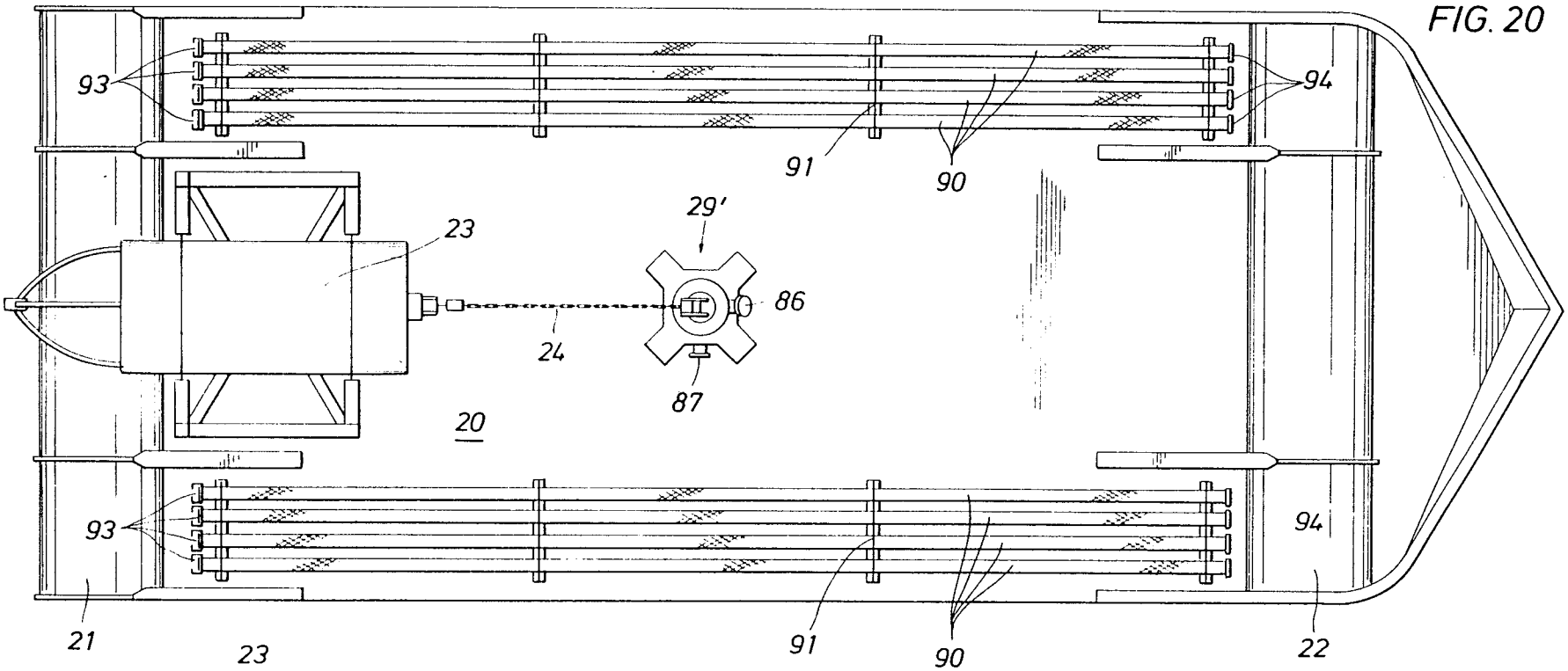
FIGS. 19 and 20 illustrate an alternative embodiment of the invention in which the pipeline reel and the hose reel are omitted from the system of FIGS. 1 and 2 or FIGS. 11–13 and in which the tanker hose is removably secured to the base for connection and deployment between a tanker and the base.
Figure 19:
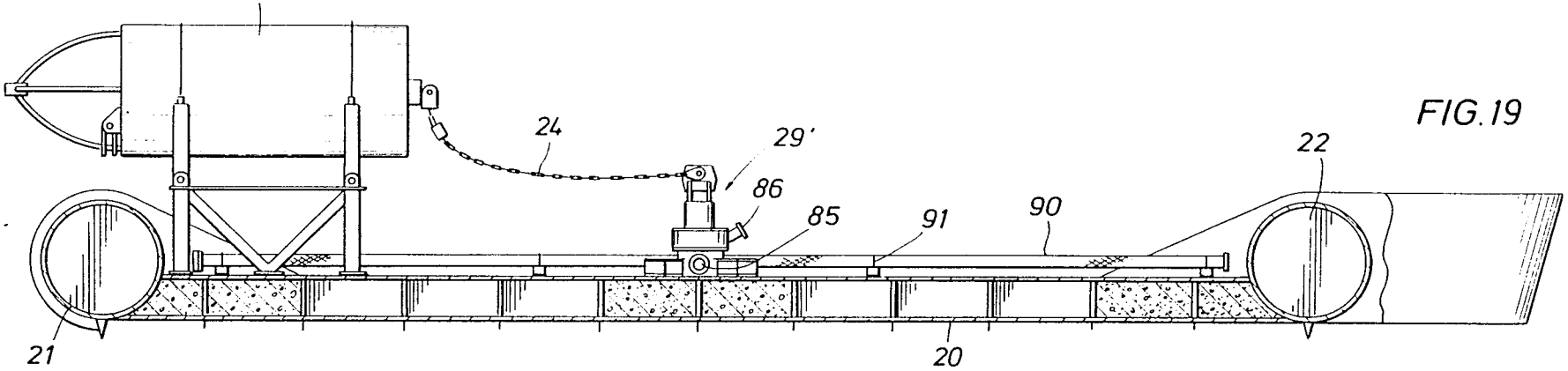

Shallow and Deep Water Embodiments Without Hose Reel and Pipeline Reel but With Hose Sections Another embodiment of the invention is illustrated in FIGS. 19 and 20. The pipeline reel and tanker hose reel of the embodiments of FIGS. 1, 2 and FIGS. 11–13 are replaced by tanker hose sections 90 releasably secured to the base 20 by means of hose lashings 91. Tanker hose sections 90 have connecting means 94, 93 provided at each end to connect a cargo laden tanker to a tanker hose connection flange of connection conduit 86 of the swivel piping means 29'. The connecting means 94, 93 may be bolting flanges or alternatively quick connect couplings. A pipeline connection flange of connection conduit 87 is provided to connect a pipeline to a shore facility deployed by a conventinal reel barge or by other specially designed separate deployment means.

In operation, the system illustrated in FIGS. 19 and 20 is transported to a position convenient to an offshore location storage facilities to be connected with an ocean going tanker. In relatively shallow water the system is deployed on the sea floor according to the method illustrated in FIGS. 3, 4, 5 and 6. Before sinking of the base, the tanker hose sections 90 are released from lashings 91. During the sinking of the base to the sea bed, the sections 90 are assembled end to end into a floating hose string. The hose string comprising lengths of hose sections 90' is connected to the tanker hose connection conduit 86 of the swivel piping means 29' during the lowering of the base 20 to the sea floor, or after the base has been set on the sea bed. The hose string is connected to the tanker. Diver assistance in assembling the tanker base sections and connection of the tanker hose conduit 86 of swivel piping means 29' is required during deployment of the system illustrated in FIGS. 19 and 20.

In other respects, the system of FIGS. 19 and 20 is substantially the same as that of FIGS. 1 and 2. The relatively deep water embodiment of the system illustrated in FIGS. 11, 12 and 13 (of course without the pipeline and hose reels) may be also used with the embodiment of FIGS. 19 and 20 in order to control the setting of the base 20 on the sea bed in relatively deep water.

Alternative Method For Shallow or Deep Water Embodiment

Figure 21:
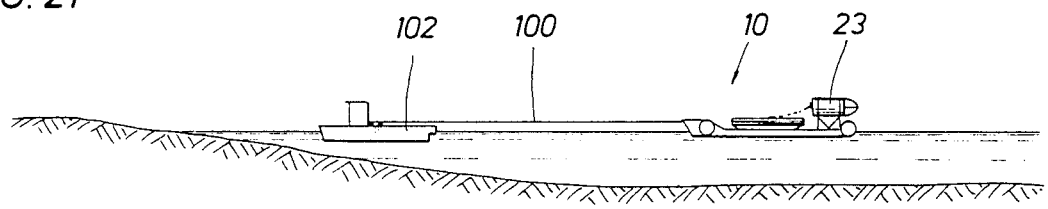
FIGS. 21–24 illustrate an alternative method for connecting the flexible pipeline to shore by attaching a winch line to the end of the pipeline and then towing the system offshore to a deployment location while unspooling the pipeline from the pipeline reel.
Figure 22:
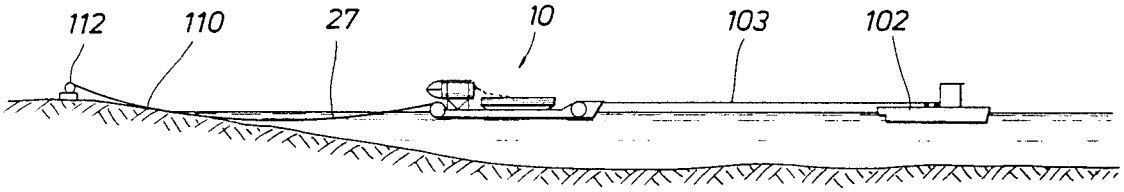
Figure 23:
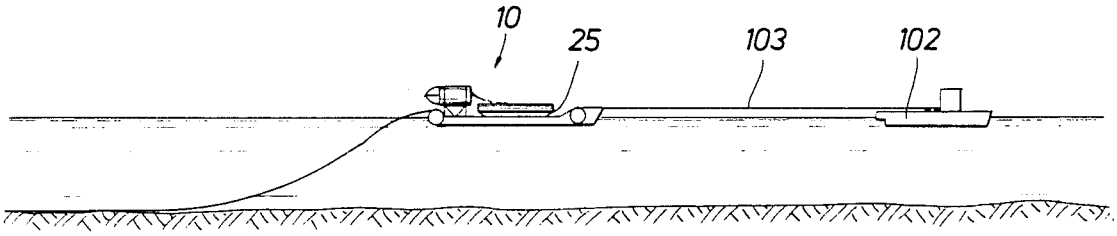
Figure 24:
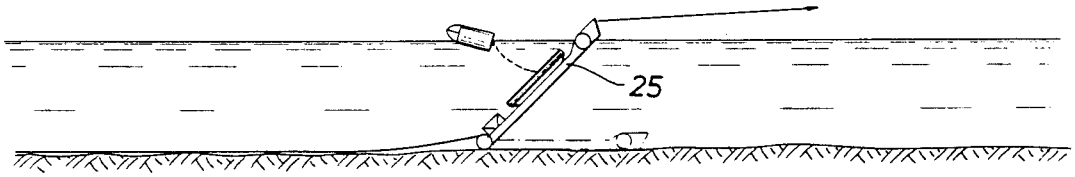
Figure 25:
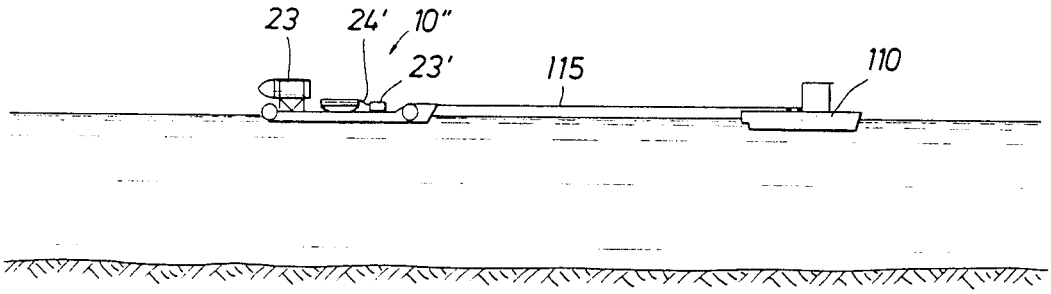
FIGS. 25–28 illustrate an alternative system and method for its deployment in extremely shallow water, the system having an auxiliary or secondary buoy which serves to vertically orient an anchor chain connected to the base of the system on the sea floor and allows attachment of a mooring rope from the vessel to the anchor chain.
Figure 26:
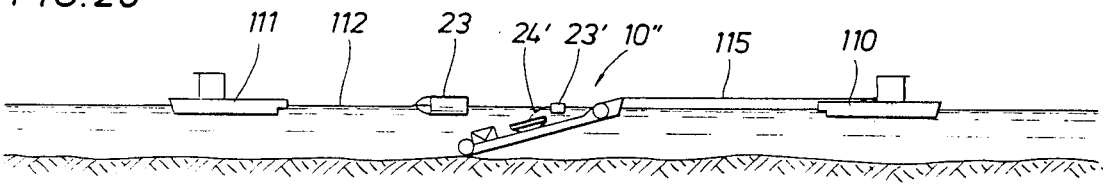
Figure 27:
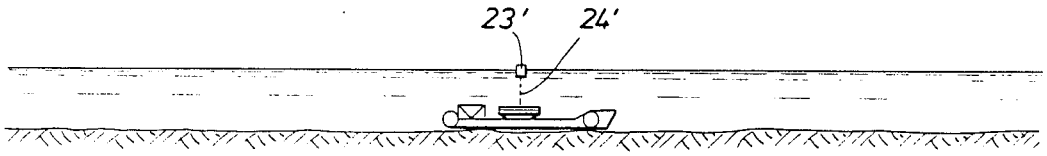

FIGS. 21–24 illustrate an alternative method for deploying either the shallow water or relatively deeper water system 10 (or 10'). FIG. 21 shows the system 10 being towed as close to shore as possible by means of a towing vessel 102. In FIG. 22, the system 10, before it is deployed on the sea floor has the end of its flexible pipeline 27 secured to a winch line 110 unspooled from an onshore winch 112. The system 10 is then towed to its deployment location by towing vessel 102 (as illustrated in FIG. 23) while the pipeline 27 is unspooled from reel 25. The system is deployed as illustrated in FIG. 24 according to one of the methods described in this invention depending on whether the deployment location has relatively shallow water or relatively deep water.

Extremely Shallow Water Embodiment With an Auxilliary Buoy

FIGS. 25–28 illustrate an alternative system and method for deploying the system according to the invention in extremely shallow water where the primary buoy doesn't have enough water to vertically orient its anchor chain connecting it to the base of the system. In addition to the primary buoy 23, an auxiliary or secondary buoy 23' is connected to the base of the system by means of anchor chain 24'. At the deployment location, illustrated in FIG. 26, the primary buoy 23 is allowed to float free as the system 10'' sinks to the sea floor. An auxiliary towing vessel 111 may be used to pull primary buoy 23 away from the system 10''.

As the system 10'' is deployed on the sea floor, secondary buoy 23' floats on the surface of the sea operably vertically orienting anchor chain 24'.

Figure 28:
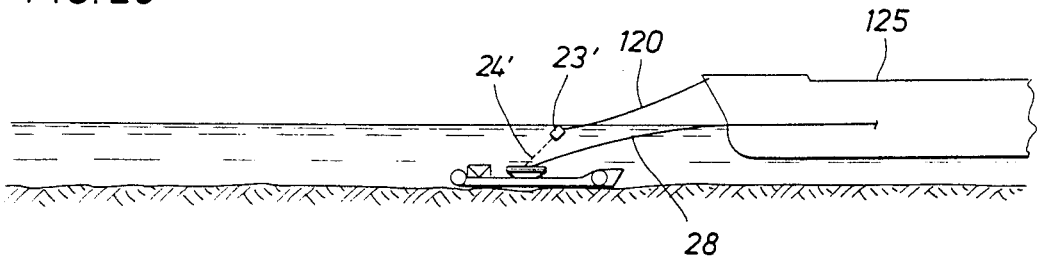

As illustrated in FIG. 28, a tanker 125 may be moored by attaching a mooring line 120 to anchor chain 24' and buoy 23' and the tanker hose 28 may be connected between the system 10'' and tanker 25. A pipeline to shore connecting an onshore storage facility with the tanker 125 and line 28 may be provided according to one of the methods and systems described above.

It should be understood that the smaller secondary buoy 23' will provide substantially less restoring force than the primary buoy. The compliancy of the mooring system will therefore be much reduced, and the moored tanker cannot safely remain at the mooring in as severe sea conditions as when the primary buoy is used.

Deep Water Embodiment With Three Step Deployment Sequence

Figure 29:
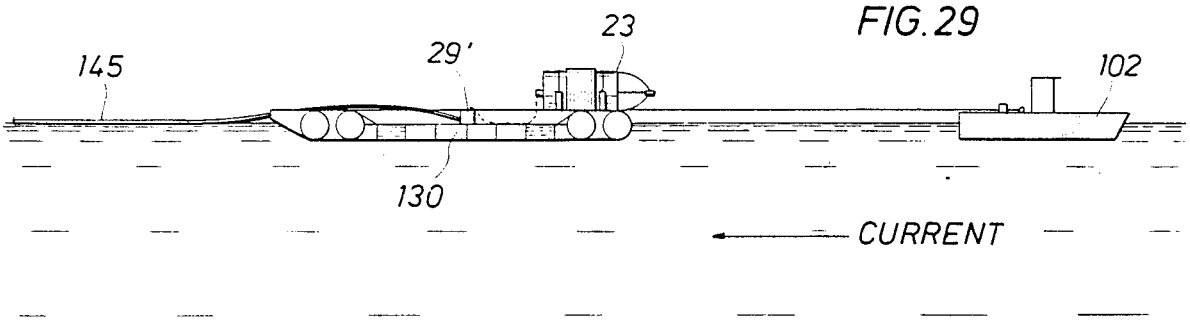
Figure 30:
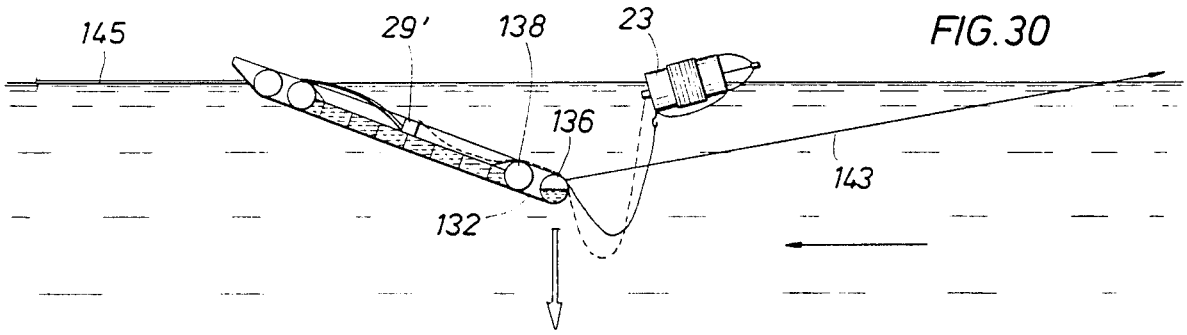
Figure 31:
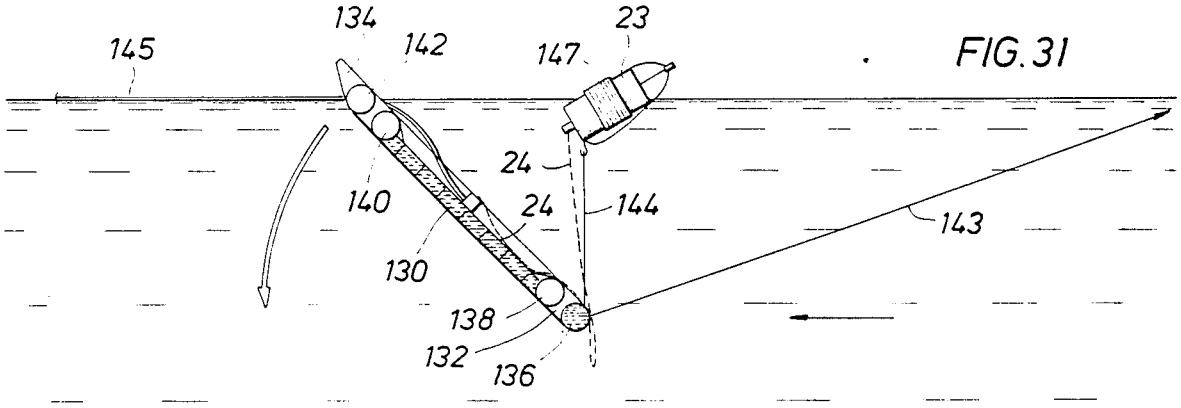
Figure 32:
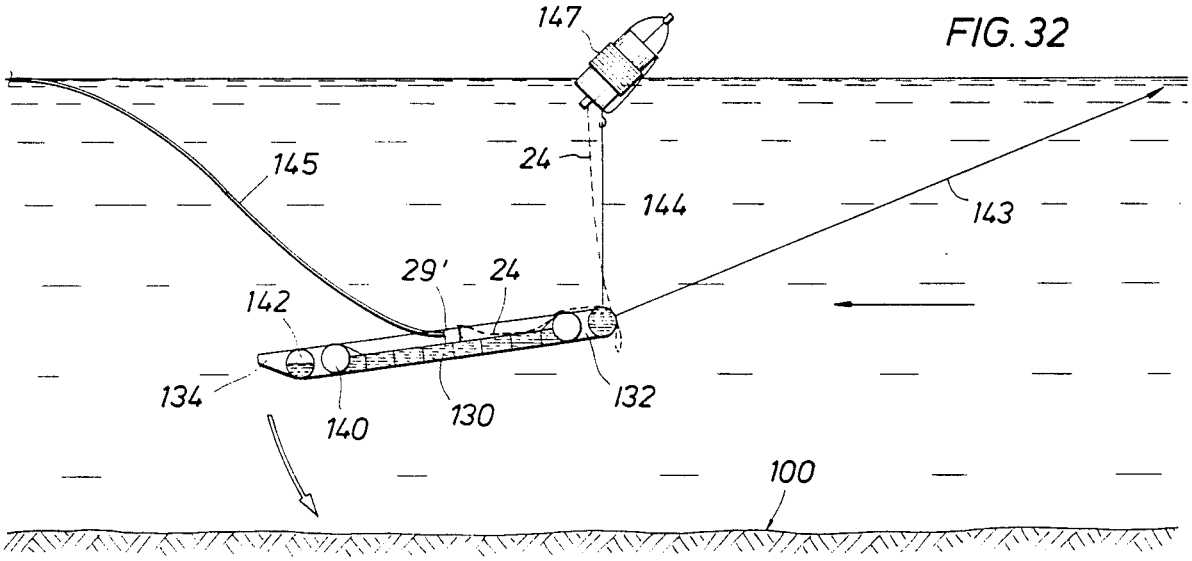

FIGS. 29–36 illustrate an alternative deep water system and method for deploying a mooring and transfer system in deep water. As best shown in FIG. 31, the offshore bulk fluid transfer system comprises a base 130 having a first end 132 and a second end 134. The system further comprises a first buoyancy tank 136 and a second buoyancy tank 138 disposed at the first end 132 and a third buoyancy tank 140 and a fourth buoyancy tank 142 disposed at the second end 134. The four buoyancy tanks may comprise a multiplicity of internal chambers to allow partial flooding of the individual tanks.

The base 130 of the system illustrated in FIGS. 29–41 may have tanker hose sections 90 releasably secured thereto, as shown on the base in FIGS. 19 and 20. The relatively rigid hose sections 90 may be connected end to end by connecting means 93, 94 to form a submarine hose string 145. The submarine hose string 145 from a tanker (not shown) is connected to the inlet end of the product swivel piping means 29' disposed on the base 130. A submarine pipeline 146 to a storage facility or a source of bulk fluid (such as a subsea well, not shown)

is installed separately by one of the methods disclosed in this invention and connected to the outlet end of the product swivel piping means 29', as shown in FIG. 36.

A mooring buoy 23, as illustrated in FIG. 29, is initially carried by the base 130 to the deployment location. A length of flexible tanker hose 147 is wrapped around the buoy 23. After deployment of the base 130 on the sea floor 100 the hose 147 may be connected to the end of the submarine hose string 145 for connection with a tanker or the like.

An anchor leg or tether 24 is connected between buoy 23 and swivel piping means 29' and is draped about the first end 132 of base 130. When the bridle line 144 of the base 130 is released, the tether 24 will be tightened as the base 130 settles on the sea floor 100. The buoy 23, directly tethered to the deployed base, may be connected with a tanker (not shown) by means of line 190, as shown in FIG. 36, during transfer of fluid.

During deployment of the base 130 to the sea floor 100, the first end 132 is held at a predetermined depth from the sea floor 100 by bridle line 144, as is best illustrated in FIGS. 31–34.

In the use and operation of this apparatus, the offshore bulk transfer system may be deployed in water having substantially no current without regard for alignment of the base with the sea current. When there is sea current, however, the base is first aligned with the current, as shown in FIGS. 29–36. The submarine hose 145 is connected to the swivel piping means 29'. The system is then positioned into the current by use of a towing vessel 102 to prepare for submergence of the base 130, as shown in FIG. 29. In preparation for the submergence of the mooring base 130, one or more anchor vessels are anchored a substantial distance up current from the intended base location. A stay line 143 is extended from an anchor vessel to the mooring base 130 to aid in the positioning of the base 130. Additional stay lines (not shown) from other vessels anchored up and down current from the base may be used to aid in the positioning of the base 130. Hold-down straps securing the buoy 23 to the base 130 are then released.

The first buoyancy tank 136 is flooded to submerge the base 130 at the stern 132, as shown in FIG. 30. The flooding rate, descent and velocity is controlled by selective opening of control (not shown) valves disposed on top of the base 130. The stern (or first end, and for deployment in current, the "up current" end) 132 of the base will be arrested or held at a predetermined depth by the bridle line 144 attached to the lower side of the floating buoy 23. As shown in FIG. 31, the buoyancy tank 136 is completely flooded to tension the bridle line 144. The tensioned line 144 maintains stability of the base while the bow (or second end or "down current end") 134 is being submerged.

Flooding of the buoyancy tank 142 in the second end 134 of the base 130 is then initiated. The base 130 rotates about the first end 132 until the bow or second end 134 engages the sea floor 100, as is shown in FIG. 33. The length of the bridle line 144 and therefore the submergence depth of the first end 132 remains the same in the steps shown in FIGS. 31–34.

As shown in FIG. 35, the buoyancy tank 142 is then completely flooded to insure stability of the second end 134 of the base 130 while the stern or first end 132 is descending to the sea floor 100. A tripping line 148 on the buoy 23 is picked up and pulled to release the latch hook holding the bridle line 144 to the bottom of the buoy 23. The stern or first end 132 then gradually descends to the sea floor 100. The tanks 138 and 140 are then completely flooded to deploy the base 130 to the sea floor 100 in its fully deployed position, as is shown in FIG. 36. The flexible hose 147 is then removed from the buoy 23 for connection to the submarine hose string 145, as shown in FIG. 36.

Method For Retrieving the Base From the Sea Floor

FIGS. 37–40 illustrate a method of retrieving the base 130 from the sea floor 100. Divers are deployed to connect positioning line 152 to the first end or stern 132 and a positioning line 154 to the bow or second end 134 of the base 130. Additional positioning lines may be used by vessels to assure that the entire system will not drift off position during the ascension of the base 130 to the sea surface. Where necessary to free the base 130 from being stuck in mud of the sea floor, divers then connect an air pressure line 156 and a water jetting line 158 from the vessel 102 safely positioned from the base 130. Jetting water is then pumped through line 158 to break engagement or suction between the bottom of the base 130 and the sea floor 100.

As shown in FIG. 38, the buoyancy tanks 140 and 142 in the bow end 134 are then deballasted to rotate the base to a substantially vertical position. Deballasting is effected by forcing the water out by compressed air through pressure line 156. Lines 152 and 154 are maintained in tension by their respective vessels (not shown) to align the base 130 with the current (if any) and to maintain overall position during the base ascension. As shown in FIG. 39, buoyancy tanks 136 and 138 in the first end 132 are then partially deballasted to allow a vertical ascension of the base 130.

Figure 40:
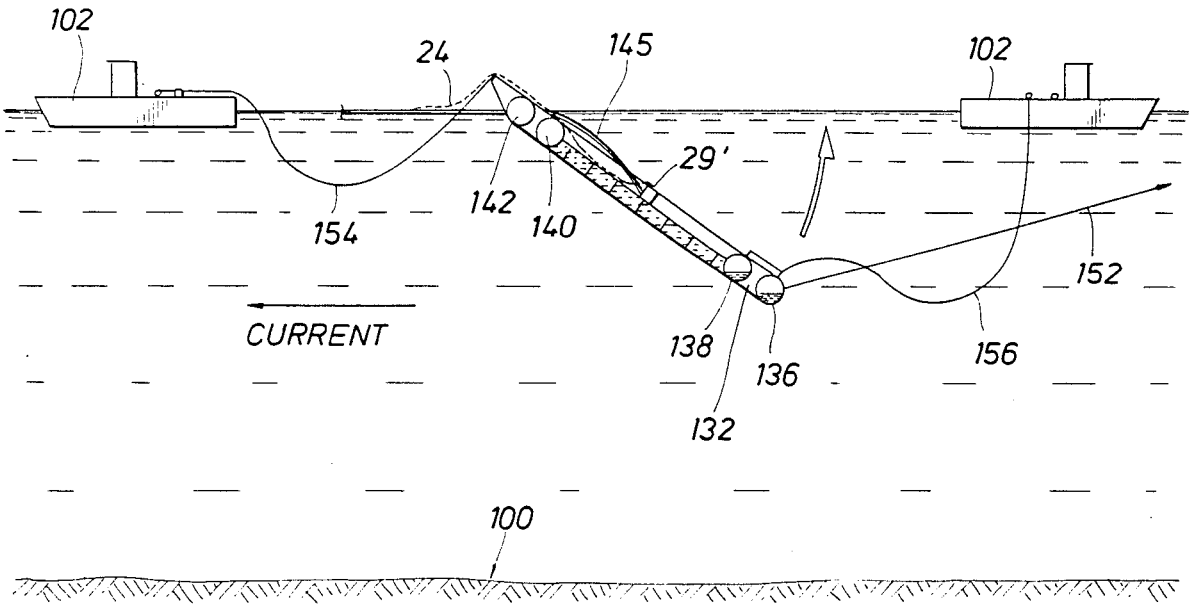
Figure 41:
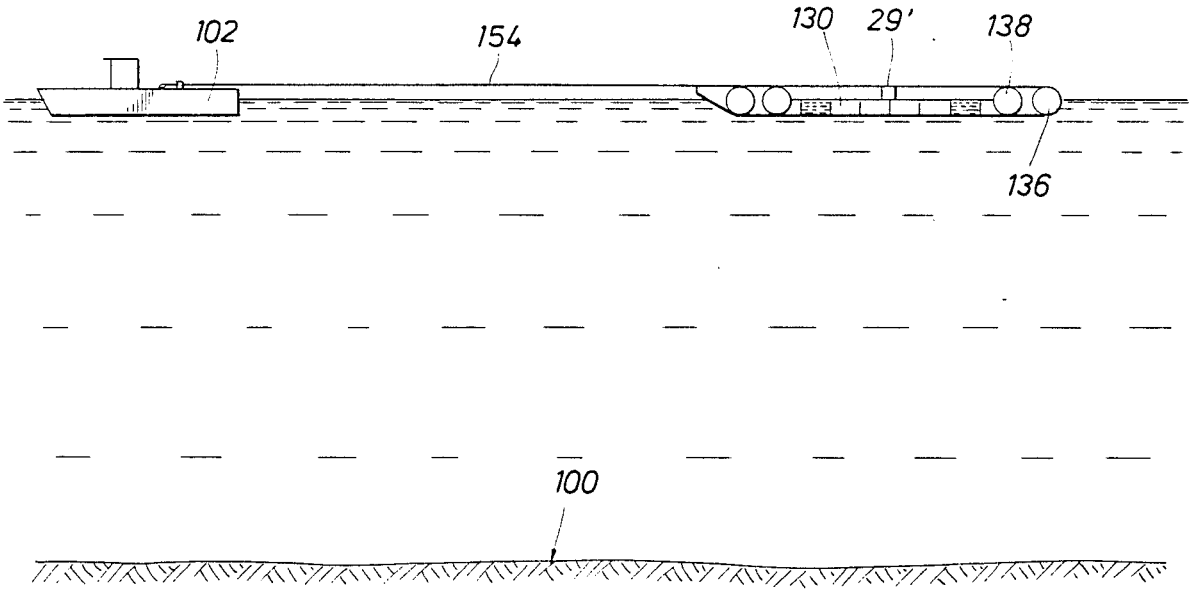

Further deballasting of tanks 136 and 138 causes the first end 132 to rotate to the sea surface, as shown in FIG. 40. The base may then be towed to another site by a towing vessel 102. Mooring buoy 23, tether 24, and submarine hose string 145 are disconnected from the base 130 for independent towing. Prior to towing, all base compartments are deballasted and all valves, vents and inspection hatches are closed and secured.

Deep Water Embodiment With Longitudinally Positioned Bouyancy Tanks

Figure 44:
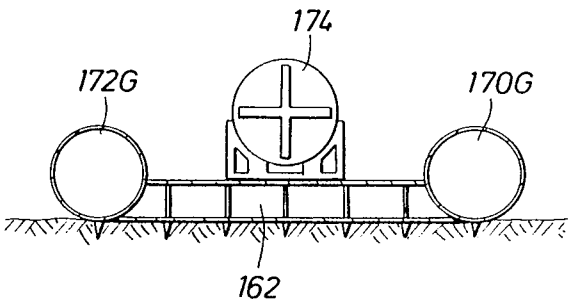
FIGS. 42–44 illustrate a side, top and section view of an alternative embodiment of the invention in which tanker hose is removably secured to the base and the buoyancy tanks are positioned end to end on each side of the base.
Figure 43:
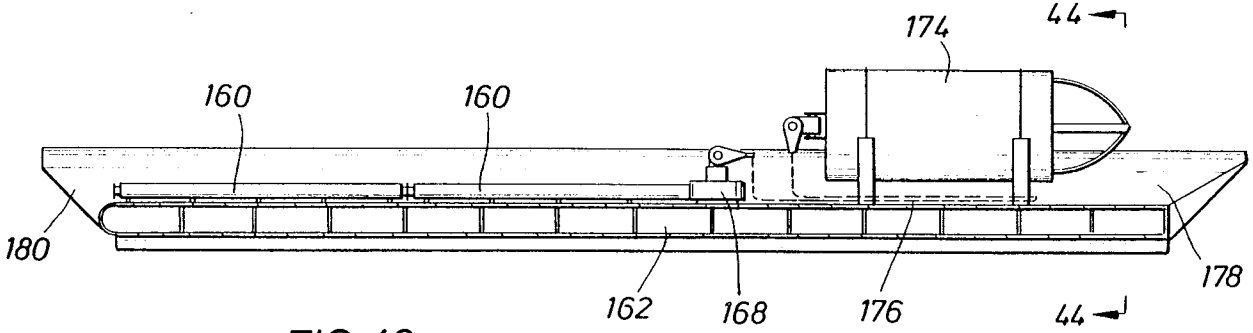
Figure 42:
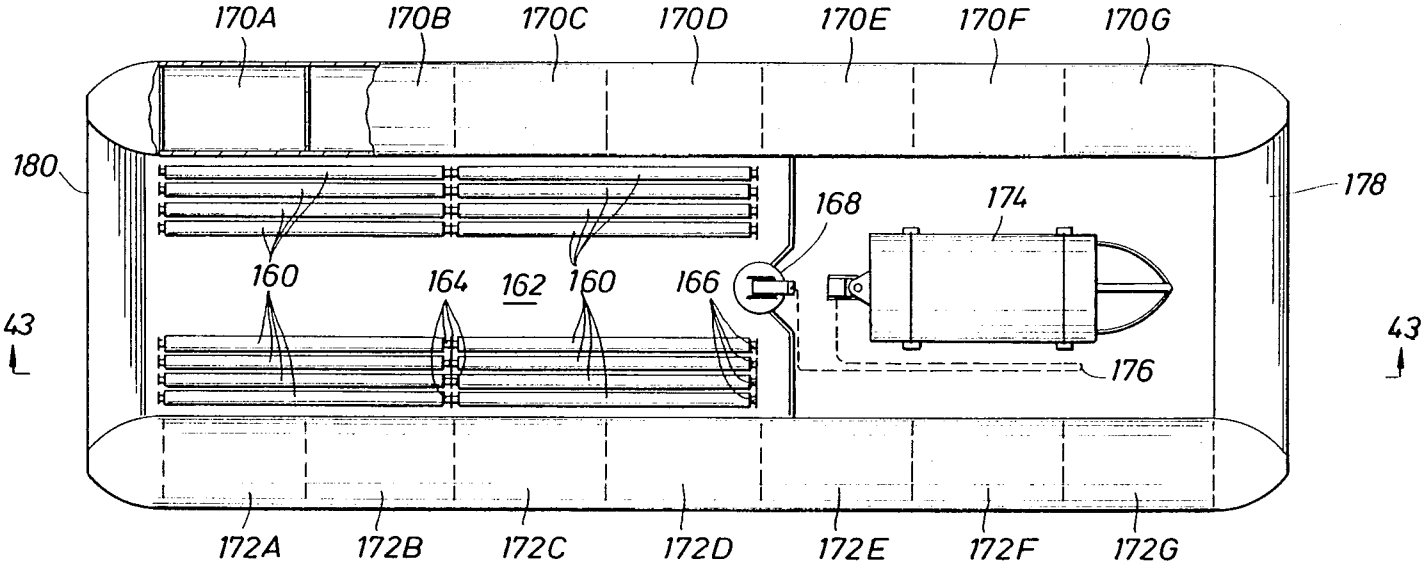

Another deep water embodiment of the invention is illustrated in FIGS. 42–44. The pipeline hose reel and tanker hose reel of the embodiments of FIGS. 1, 2 and 11, 12 and 13 are eliminated. Tanker hose sections 160 having connecting means 164, 166 are provided for communicating fluid between a tanker or vessel to the outlet of the swivel piping means 168, similar to string 145. The connecting means 164, 166 may be bolting flanges or alternatively quick connect couplings. An inlet to piping means 168 is provided to connect a submarine pipeline to a shore facility or to a subsea well, similar to the pipeline 146 shown in FIG. 36. The pipeline 146 may be deployed by a conventional reel barge or by other specially designed separate deployment means.

The embodiment illustrated in FIGS. 42–44 is distinguished from the previous embodiments in that buoyancy tanks 170 and 172 are disposed longitudinally on each side of the base 162. As best shown in FIG. 42, a plurality of buoyancy tanks 170A, 170B, 170C, 170D, 170E, 170F, and 170G are positioned end to end on one side of base. On the other side of the base 162 are buoyancy tanks 172A, 172B, 172C, 172D, 172E, 172F, and 172G corresponding to the buoyancy tanks 170 running the length of the base 162.

FIG. 43, a section along line 43—43 of FIG. 42, illustrates the positioning of the buoy 174 on base 162. An anchor leg or tether 176, connected between buoy 174 and swivel piping means 168, is draped about the stern end 178 of the base 162. The length of tether 176 is sized so as to allow deep water deployment of the base 162 while buoy 174 floats on the sea surface.

FIG. 44, a section along lines 44—44 of FIG. 43, illustrates the base 162 with buoyancy tanks 172G and 170G and buoy 174. The offshore bulk fluid transfer system, as shown in FIGS. 42–44, comprises the base 162 having a first end 178 and a second end 180. The buoyancy tanks 170 and 172 may comprise a multiplicity of internal chambers to allow partial flooding of the individual tanks.

In operation of the apparatus illustrated in FIGS. 42–44, the system is transported to an offshore deployment position. Prior to deploying the base, the tanker hose sections 160 are released from the base 162 and assembled end to end into a floating hose string, similar to string 145 in FIGS. 29–40. The hose string is connected to the swivel piping means 168 prior to submerging the base to the sea floor.

The offshore bulk fluid transfer system, as shown in FIGS. 42–44, may be used in the method shown in FIGS. 29–41. Selected buoyancy tanks 170 and 172 are flooded to submerge a selected end of the base 162. For example, to submerge the first end 178, buoyancy tanks 170G and 172G may be flooded and, if required, buoyancy tanks 170F and 172F are also flooded. Similarly, to submerge the second end 180 of base 162, buoyancy tanks 170A and 172A are flooded and, if required, buoyancy tanks 170B and 172B are also flooded. The flooding rate, descent and velocity of the base 162 is controlled by selectively opening control valves disposed on the top of the individual buoyancy tanks 170 and 172.

The base 162 is retrieved from the sea surface in similar fashion as base 130, as shown in FIGS. 37 to 40. Air pressure lines are used to deballast the tanks 170, 172. Where necessary, water jetting lines may be used to break engagement between the bottom of the base 162 and the sea floor 100.

Deep Water Embodiment With Four Step Deployment Sequence

Figure 45:
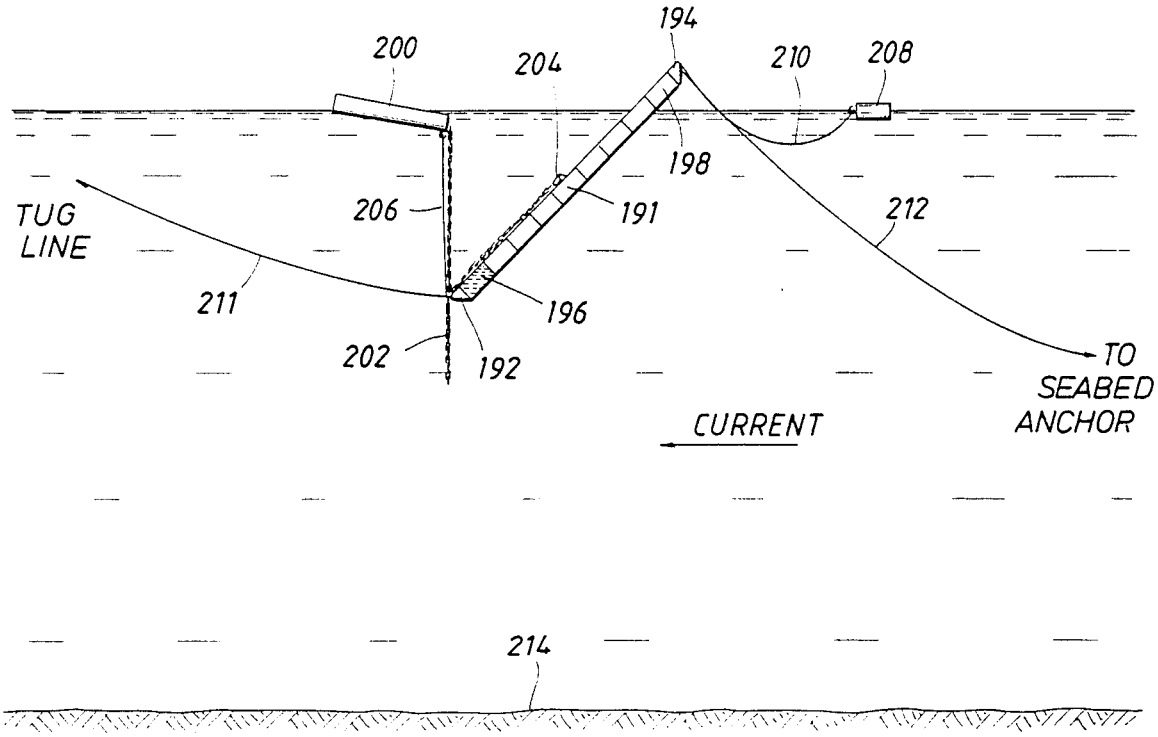
FIGS. 45–48 illustrate an alternative system and method for deep water deployment, the system having an auxilliary buoy and primary buoy which serve to deploy the base on the sea floor in a four step deployment sequence.
Figure 46:
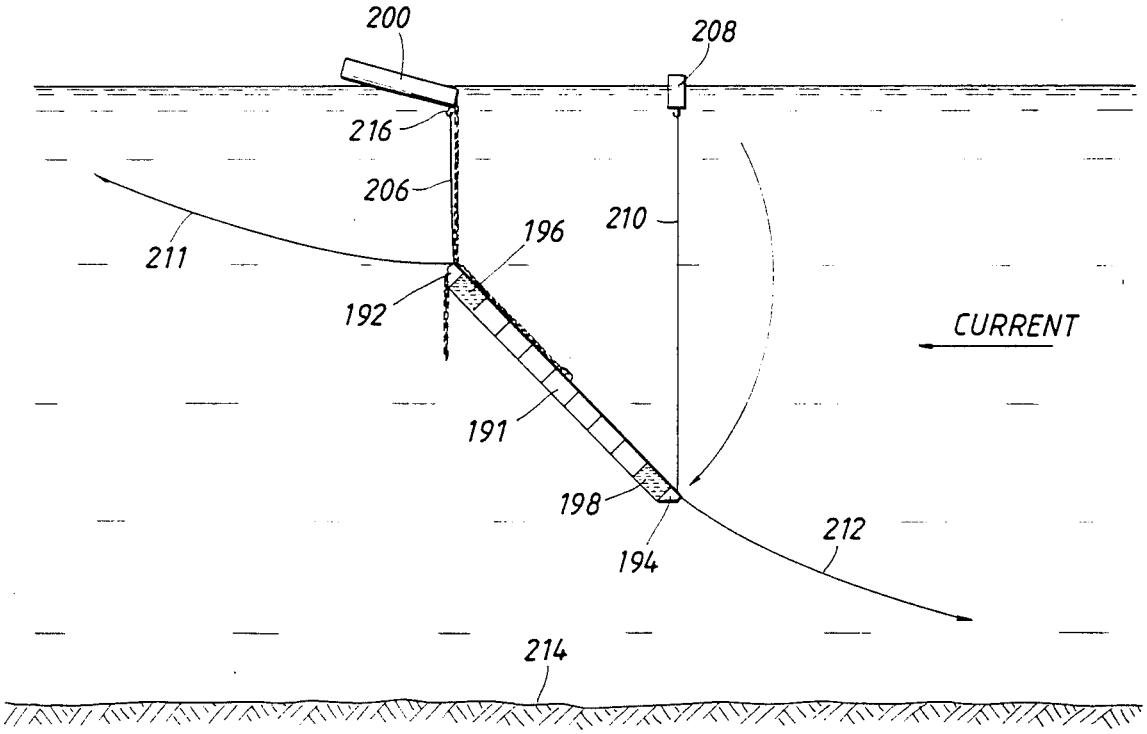
Figure 47:
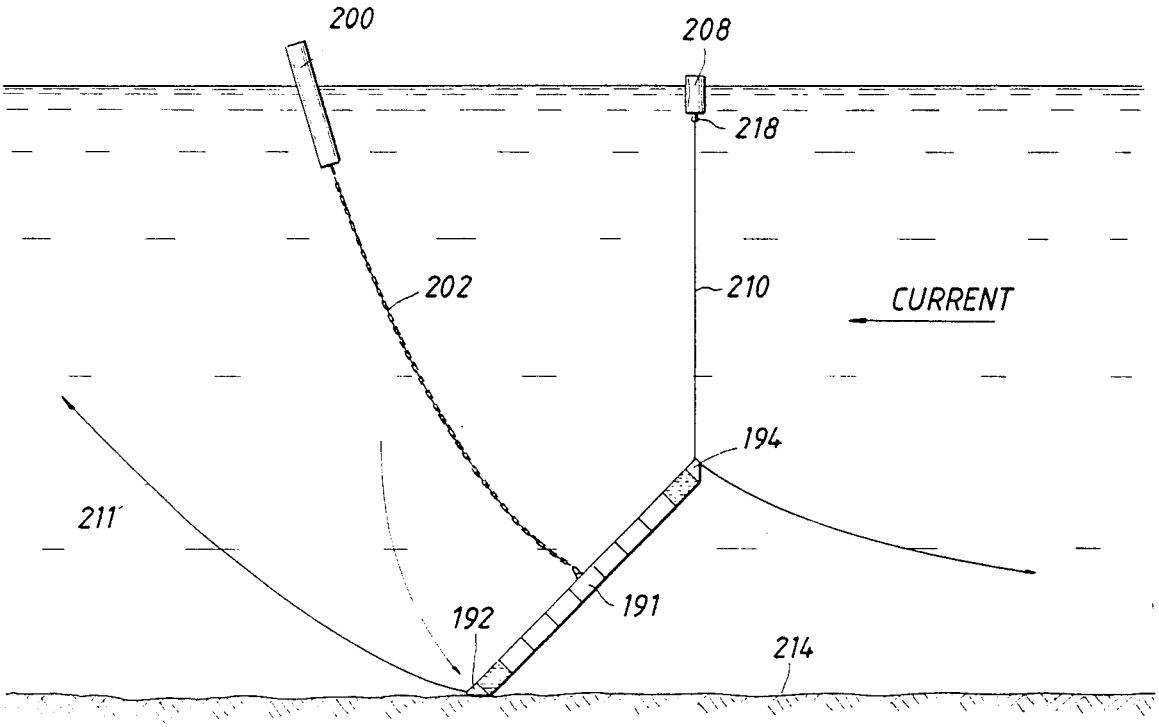

FIGS. 45–48 illustrate an alternative deep water system and method for deploying a mooring and transfer system in deep water in a four step sequence. As best shown in FIGS. 45–47, the offshore bulk fluid transfer system comprises a base 191 having a first end 192 and a second end 194. The system further comprises a first buoyancy tank 196 disposed at the first end 192 and a second buoyancy tank 198 disposed at the second end 194. The buoyancy tanks are preferably disposed longitudinally on each side of the base 191, similar to the embodiment illustrated in FIGS. 42–44 or, alternatively, may be positioned as in the embodiment illustrated in FIGS. 19 and 20. Each buoyancy tank may comprise a multiplicity of internal chambers to allow partial flooding of individual tanks.

Furthermore, the base 191 of the system illustrated in FIGS. 45–48 may have tanker hose sections releasably secured thereto as shown on the base in FIGS. 19 and 20 and FIGS. 42 and 43. These hose sections are fabricated and connected as previously described.

A primary mooring buoy 200, as illustrated in FIGS. 45–46, is initially carried by the base 191 to the deployment location. A length of flexible tanker hose may be wrapped around the buoy 200 for connection between a tanker and the base 191, as previously disclosed.

Figure 48:
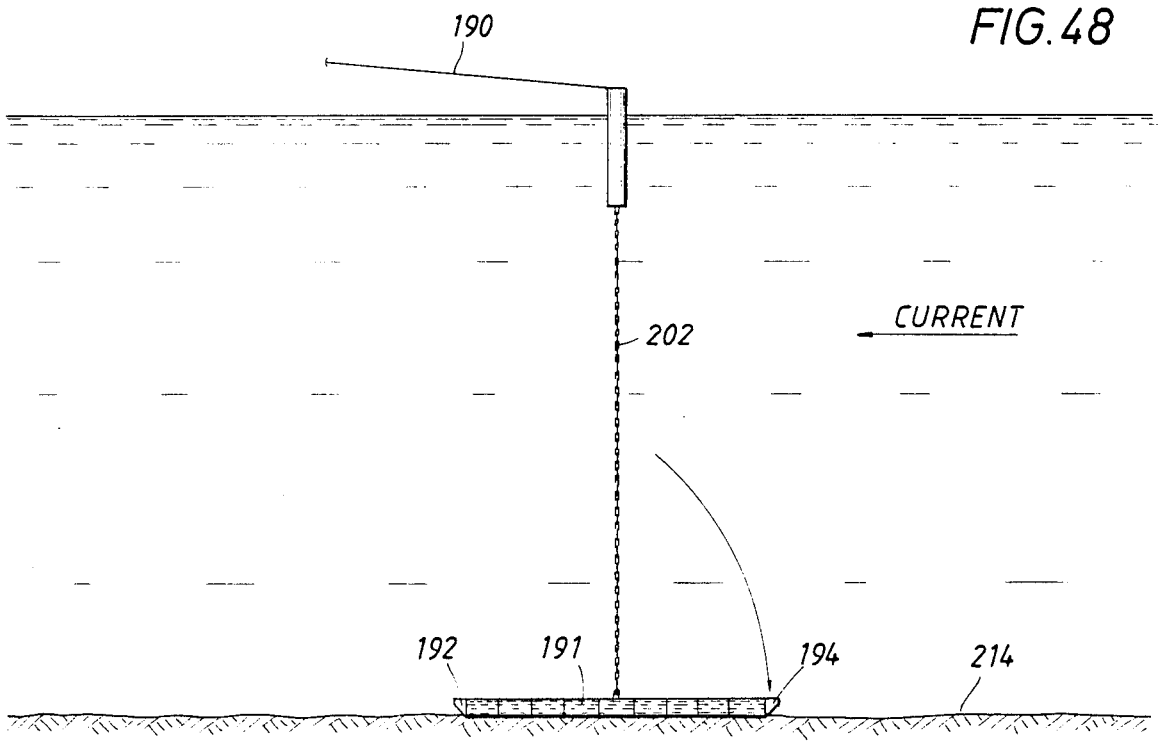

An anchor leg or tether 202 is connected between the buoy 200 and the swivel piping means 204 and is draped about the first end 192 of the base 191. The primary buoy 200, directly tethered to the deployed base 191, may be connected to a tanker (not shown) by means of a line 190, as best shown in FIG. 48, during transfer of fluid. A support sling 206 provides the means for holding the flooded first end 192 of the base 191 at a predetermined depth.

An auxilliary buoy 208 and a second support sling 210 provide the means for holding the second end 194 of the base 191 at a predetermined depth. The auxilliary buoy 208 may be carried to the deployment location by the base or may be carried independently by a towing vessel. The support sling 210 is releasably secured between the auxilliary buoy 208 and the second end 194.

In the use and operation of this system, the offshore bulk fluid transfer system may be deployed in water having substantially no current without regard for alignment of the base with the sea current. Where there is sea current, however, the base 191 is first aligned with the current, as shown in FIGS. 45–48. The system is positioned into the current by use of a tug line 211 connected to a towing vessel to prepare for submergence of the base 191, as shown in FIG. 45. A line 212 is preferably connected between the second end 194 and a sea bed anchor to aid in positioning of the base 191. Additional lines (not shown) from other anchor means up current and down current from the base 191 may be used to aid in the positioning of the base 191. Hold down straps (not shown) securing the primary buoy 200 and the auxilliary buoy 208 to the base 191 are then released.

The first end 192 is flooded to submerge the base 191, as shown in FIG. 45. The flooding of the first end 192 may be preferably accomplished as disclosed for the system illustrated in FIGS. 42–44. The flooding rate, descent and velocity is controlled by the selective opening of control (not shown) valves disposed on the top of the base 191. The first end or the down current end 192 of the base 191 will be arrested or held at a predetermined depth by the support sling 206 attached to the lower side of the floating primary buoy 200. As shown in FIGS. 45 and 46, the buoyancy tnk 196 is completely flooded to tension the support sling 206. This support sling 206 maintains stability of the base 191 while the second end or up current end 194 is being flooded.

Flooding of the buoyancy tank 198 in the second end 194 of the base 191 is then initiated. The base 191 now rotates about the first end 192 until the second end 194 is at a depth closer to the sea floor 214 than the first end 192. Preferably the second end 194 rotates approximately ninety (90) degrees about the first end 192 and is held at that point by the support sling 210 connected between the auxilliary buoy 208 and the second end 194.

A trip line on the buoy 202 is picked up and pulled to release the latch hook 216 holding the support sling 206 to the bottom of the buoy 200. The first end 192 then gradually descends to the sea floor 214. As shown in FIG. 47, the tether 202 will be tightened as the base 191 settles on the sea floor 214. A trip line on the secondary buoy 208 is then picked up and pulled to release the latch hook 218 holding the support sling 210 to the bottom of the secondary buoy 208. The second end 194 then gradually descends to the sea floor 214. The remaining buoyancy tanks are then completely flooded to fully deploy the base 191 to the sea floor 214, as shown in FIG. 48. The connection of the pipeline and tanker hose, as best shown in FIG. 36, may be completed.

The method of retrieving the base 191 from the sea floor 214 may be accomplished using the method as disclosed in this invention, illustrated in FIGS. 37–40.

Various modifications and alterations in the described system and method will be apparent to those skilled in the art from the foregoing description which does not depart from the spirit of the invention. The foregoing disclosure and description mentioned are illustrative and explanatory thereof and details of the illustrative embodiments may be made without departing from the spirit of the invention.

What is claimed is:

1. A method for deploying an offshore bulk fluid transfer system to the sea floor, said transfer system having a base with a first end and a second end with means for flooding the first end and means for flooding the second end, the method comprising the steps of, positioning the offshore bulk transfer system at a deployment location, flooding the first end of the base of the system causing the first end to sink towards the sea floor, holding the first end of the base at a predetermined depth from the sea floor by securing a bridle line between the first end of the base and a floating buoy, flooding the second end of the base so that the base rotates about the first end until the second end of the base engages the sea floor, and releasing the first end of the base operably enabling the first end of the base to sink to the sea floor.

2. The method of claim 1 further comprising the step of positioning the transfer system substantially in alignment with the current whereby the first end of the base of the system is the up current end of the base and the second end of the base is the down current end of the base.

3. The method of claim 1 wherein the system comprises at least one buoyancy tank disposed at the first end of the base, at least one buoyancy tank disposed at the second end of the base, said buoyancy tanks providing flotation for the system during positioning of the system to a mooring location and adapted for flooding to allow the system to be disposed on the sea floor.

4. The method of claim 3 wherein said system further comprises coupling means disposed on said base for coupling a pipeline and a tanker hose.

5. The method of claim 4 further comprising the steps of, connecting the pipeline between said coupling means and a storage facility, and connecting the hose between a vessel and said coupling means.

6. The method of claim 5 wherein the hose includes a plurality of rigid hose sections connected from said coupling means and a flexible hose connected between said rigid hose sections and the vessel.

7. The method of claim 4 further comprising the steps of connecting the pipeline between said coupling means and a source of bulk fluid, and connecting the hose between a vessel and said coupling means.

8. The method of claim 3 wherein the steps of flooding comprise the sub-steps of:

flooding one buoyancy tank at the first end to sink the first end towards the sea floor, flooding one buoyancy tank at the second end so that the second end of the base rotates about the first end until the second end engages the sea floor, and flooding all buoyancy tanks of the base to secure the base on the sea floor.

9. The method of claim 1 wherein said system includes a mooring buoy releasably secured to the base of the system and a tether between the base and the buoy, the method further including the step of, releasing the mooring buoy from the base to float on the sea surface while being tethered to the base.

10. The method of claim 9 wherein said system includes a flexible hose releasably secured about said mooring buoy and a coupling means disposed on the base and the method further includes the step of removing the flexible hose from the mooring buoy for connection between a vessel and said coupling means.

11. The method of claim 1 further comprising the step of:

releasing the bridle line after the second end engages the sea floor.

12. A method of retrieving an offshore bulk fluid transfer system for a sea floor comprising the steps of:

connecting positioning lines to a first end and a second end of a base of the system, tensioning the lines to assure proper position of the base during the ascension of the base to the sea surface, deballasting a buoyancy tank disposed at the first end of the base to raise the end to a substantially vertical position, deballasting a buoyancy tank disposed at the second end of the base to raise the first end to the sea surface, deballasting the buoyancy tank disposed at the second end of the base further to rotate the second end to the sea surface for surface towing of the base, and jetting water between the base and the sea floor to break engagement between the base and the sea floor.

13. An offshore bulk fluid transfer system comprising, a base having a first end and a second end, at least one buoyancy tank disposed at the first end of the base, at least one buoyancy tank disposed at the second end of the base, said buoyancy tanks providing flotation for the system during positioning of the system at a mooring location and adapted for flooding to allow the system to be disposed on a sea floor, means for holding the first end of said base at a predetermined depth from the sea floor including a mooring buoy means floating on the sea surface, and a bridle line releasably connected between the first end of the base and said mooring buoy means.

14. The transfer system of claim 13 further comprising coupling means disposed on said base for coupling a pipeline between a storage facility and said base and a hose provided between a vessel and said base.

15. The transfer system of claim 13 further comprising coupling means disposed on said base for coupling to a transfer line between a source of bulk fluid and a hose provided between a vessel and said base.

16. The transfer system of claim 13 further comprising a second mooring buoy means tethered to said base.

17. The system of claim 13 further comprising a first side and a second side of said base, a plurality of buoyancy tanks disposed end to end between said first end and said second end of said base adjacent said first side, and a plurality of buoyancy tanks disposed end to end between said first end and said second end of said base adjacent said second side.

18. A method for deploying an offshore bulk fluid transfer system to the sea floor, said transfer system having a base with a first end and a second end with means for flooding the first end and means for flooding the second end, means for supporting the first end of the base at a predetermined depth including a primary mooring buoy and a first support sling and means for supporting the second end of the base at a predetermined depth including an auxiliary buoy and a second support sling, the method comprising the steps of, (a) positioning the offshore bulk transfer system at a deployment location, (b) flooding the first end of the base of the system causing the first end to sink towards the sea floor, (c) supporting the first end of the base by the first support sling connected between the first end of the base and the primary mooring buoy at a depth closer to the sea floor than the second end, (d) flooding the second end of the base, (e) allowing the second end of the base to sink toward the sea floor while rotating about the first end, (f) supporting the second end of the base at a depth closer to the sea floor than the first end by the second support sling connected between the second end of the base and the auxiliary buoy, (g) lowering the first end of the base operably enabling the first end of the base to rotate about the second end, and (h) repeating steps (c) (e) (f) and (g) until the first or second end of the base engages the sea floor.

19. The method of claim 18 further comprising the step of positioning the transfer system substantially in alignment with the current in step (a) whereby the first end of the base of the system is the up current end of the base and the second end of the base is the down current end of the base.

20. The method of claim 18 wherein the system comprises at least one buoyancy tank disposed at the first end of the base, and at least one buoyancy tank disposed at the second end of the base, said buoyancy tanks providing flotation for the system during positioning of the system to a mooring location and adapted for flooding to allow the system to be disposed on the sea floor.

21. The method of claim 20 wherein said transfer system further comprises coupling means disposed on said base for coupling a pipeline provided between an onshore storage facility and said base and a tanker hose provided between a vessel and said base.

22. The method of claim 20 wherein the steps of flooding comprise the sub-steps of:

flooding a buoyancy tank at the first end to sink the first end towards the sea floor in step (b), flooding a buoyancy tank at the second end so that the second end of the base rotates about the first end in step (d), and flooding all buoyancy tanks of the base when the base is landed on the sea floor.

23. The method of claim 18 wherein said system includes the primary mooring buoy releasably secured to the base of the system and a tether between the base and the primary buoy, the method further including the step of, releasing the primary mooring buoy from the base to float on the sea surface while being tethered to the base.

24. The method of claim 18 further comprising the steps of:

releasing the support sling of one end after the other end engages the sea floor.

* * * * *